US010570652B2

(12) United States Patent
Liang et al.

(10) Patent No.: US 10,570,652 B2
(45) Date of Patent: Feb. 25, 2020

(54) INTEGRATED SASH LOCK AND TILT LATCH COMBINATION USING ONE LOCK FOR TWO TILT LATCHES

(71) Applicant: Vision Industries Group, Inc., So. Plainfield, NJ (US)

(72) Inventors: Luke Liang, So. Plainfield, NJ (US); David Chen, Guangzhou (CN); Glen Paesano, Point Pleasant Beach, NJ (US)

(73) Assignee: Vision Industries Group, Inc., So. Plainfield, NJ (US)

( * ) Notice: Subject to any disclaimer, the term of this patent is extended or adjusted under 35 U.S.C. 154(b) by 1174 days.

(21) Appl. No.: 14/879,164

(22) Filed: Oct. 9, 2015

(65) Prior Publication Data

US 2016/0060921 A1 Mar. 3, 2016

Related U.S. Application Data

(63) Continuation-in-part of application No. 14/566,908, filed on Dec. 11, 2014, which is a (Continued)

(51) Int. Cl.
*E05C 9/04* (2006.01)
*E05C 1/12* (2006.01)
(Continued)

(52) U.S. Cl.
CPC ..... *E05C 9/042* (2013.01); *E05B 9/08* (2013.01); *E05B 65/0841* (2013.01); *E05C 1/12* (2013.01);
(Continued)

(58) Field of Classification Search
CPC .... E05B 9/08; E05B 63/0056; E05B 65/0864; E05B 65/0841; E05B 65/0876;
(Continued)

(56) References Cited

U.S. PATENT DOCUMENTS 166,842 A 8/1875 Berryman
176,360 A 6/1876 Cooper
(Continued)

FOREIGN PATENT DOCUMENTS

GB 0341207 1/1931
GB 2026594 2/1980

*Primary Examiner* — Christine M Mills
(74) *Attorney, Agent, or Firm* — Thomas A. O'Rourke; Bodner & O'Rourke, LLP

(57) ABSTRACT

A sash fastener for securing a slidable and tiltable sash window includes a lock assembly and left-hand and right-hand latch assemblies. The lock assembly is mounted upon the sash window meeting rail, and includes a pivotable cam to engage a keeper on the master frame, a handle to pivot the cam, and a pair of pivotable arms, each extending into the meeting rail. A link selectively connects the two arms, and when actuation of the handle causes the cam to rotate, it may selectively drive one of the arms to pivot, with the link causing the other arm to pivot. The left- and right-hand latch assemblies each include a housing, biasing means, a latch member with an adjustable receiver clip having an opening therein configured to receive one of the arms of the lock assembly, within the meeting rail, with movement of the arms actuating the latch to permit tilting.

8 Claims, 27 Drawing Sheets

Related U.S. Application Data continuation-in-part of application No. 14/278,226, filed on May 15, 2014, now Pat. No. 10,323,446, which is a continuation-in-part of application No. 14/198,986, filed on Mar. 6, 2014, now Pat. No. 10,119,310.

(51) Int. Cl.

| | |
|---|---|
| ***E05C 3/04*** | (2006.01) |
| ***E05B 65/08*** | (2006.01) |
| ***E05B 9/08*** | (2006.01) |
| ***E05C 9/18*** | (2006.01) |
| *E05C 7/00* | (2006.01) |
| *E05C 9/20* | (2006.01) |

(52) U.S. Cl.

CPC ..... *E05C 3/045* (2013.01); *E05C 9/185* (2013.01); *E05C 9/20* (2013.01); *E05C 2007/007* (2013.01); *Y10T 292/0977* (2015.04)

(58) Field of Classification Search

CPC ... E05C 1/08; E05C 3/046; E05C 1/12; E05C 3/045; E05C 2007/007; E05C 9/185; E05C 9/20; E05C 9/025; E05C 9/042; E05C 1/16; E05C 9/00; E05C 9/04; Y10T 292/0969; Y10T 292/1039; Y10T 292/104; Y10T 292/1041; Y10T 292/0977; Y10T 292/0997; Y10T 292/0894; Y10T 292/0895; Y10T 292/0834; Y10T 292/0836; Y10T 292/0837; Y10T 292/0838; Y10T 292/0839; Y10T 292/084; Y10T 292/0841; Y10T 292/0843; Y10T 292/0844; Y10T 292/0845; Y10T 292/0846; Y10T 292/0847; Y10T 292/0848; Y10T 292/0849; Y10T 292/0851; Y10T 292/0852; Y10T 292/0853; Y10T 292/0854; Y10T 292/0855; Y10T 292/0856; Y10T 292/0857; Y10T 292/0859; Y10T 292/086; Y10T 292/0861; Y10S 292/20; Y10S 292/47; Y10S 292/63; Y10S 292/53; Y10S 292/64; Y10S 292/60; E05D 15/22

USPC ..... 292/240–242, 163, 169, 175, DIG. 20, 292/DIG. 47, DIG. 63, DIG. 53, DIG. 64, 292/DIG. 60, 80, 81, 32–55

See application file for complete search history.

(56) References Cited

U.S. PATENT DOCUMENTS 178,360 A 6/1876 Cooper
201,146 A 3/1878 Adler
336,302 A 2/1886 Dudgeon
346,788 A 8/1886 Teufel
376,252 A 1/1888 McIntyre
410,728 A 9/1889 Brown
480,148 A 8/1892 Theby
509,941 A 12/1893 Perry
512,593 A 1/1894 Webster et al.
526,118 A 9/1894 Sharp
551,242 A 12/1895 Wallace
590,225 A 9/1897 Hill
601,090 A * 3/1898 Wright ..... E05B 59/00 292/40
722,162 A 3/1903 St. Louis
759,642 A 5/1904 Sparks
878,206 A 2/1908 Johnson
948,628 A 2/1910 Jefferis
966,063 A 8/1910 Toothaker
980,131 A 12/1910 Shean
998,642 A 7/1911 Shean
1,006,211 A 10/1911 Hermon
1,041,803 A * 10/1912 Kilburn ..... E05C 9/043 292/36
1,051,918 A 2/1913 Rowley
1,059,999 A 4/1913 James et al.
1,141,437 A 6/1915 Unterlender
1,243,115 A 10/1917 Shur
1,253,810 A 1/1918 Gianninoto
1,270,740 A 6/1918 Keyes
1,393,628 A 10/1921 Leichter
1,470,951 A * 10/1923 Andersen ..... E05B 15/10 292/137
1,550,532 A 8/1925 French
1,552,690 A 9/1925 Frantz
1,704,946 A 3/1929 Lindgren
1,712,792 A 5/1929 Hansen
1,715,957 A 6/1929 Stein
1,794,171 A 2/1931 Grutel
1,864,253 A 6/1932 McIntyre
1,869,274 A 7/1932 Phillips
1,901,974 A 3/1933 Macy
1,922,062 A 8/1933 Sullivan
1,964,114 A * 6/1934 Gerlach ..... D06F 37/10 220/326
2,095,057 A 10/1937 Corrado
2,122,661 A 7/1938 Rightmyer
2,126,995 A 8/1938 Kingdon
2,272,145 A 2/1942 Anderson et al.
2,369,584 A 2/1945 Lundholm
2,452,521 A 10/1948 Johnson et al.
2,500,849 A 3/1950 Menns
2,529,020 A * 11/1950 Hawkins, Sr. ..... E05D 13/06 292/33
2,537,736 A 1/1951 Carlson
2,766,492 A 10/1956 Day et al.
2,818,919 A 1/1958 Sylvan
3,027,188 A 3/1962 Eichstadt
3,187,526 A 6/1965 Moler
3,362,740 A 1/1968 Burns
3,438,153 A 4/1969 Lemme
3,599,452 A 8/1971 Yokohama et al.
3,683,652 A 8/1972 Halopoff et al.
3,811,718 A 5/1974 Bates
3,919,808 A 11/1975 Simmons
4,068,871 A 1/1978 Mercer
4,151,682 A 5/1979 Schmidt
4,165,894 A 8/1979 Wojciechowski
4,227,345 A 10/1980 Durham, Jr.
4,253,688 A 3/1981 Hosooka
4,303,264 A 12/1981 Uehara
4,305,612 A 12/1981 Hunt et al.
4,392,329 A 7/1983 Suzuki
4,470,277 A 9/1984 Uyeda
4,475,311 A 10/1984 Gibson
4,525,952 A 7/1985 Cunningham et al.
4,580,366 A 4/1986 Hardy
4,587,759 A 5/1986 Gray
4,624,073 A 11/1986 Randall
4,639,021 A 1/1987 Hope
4,643,005 A 2/1987 Logas
4,827,685 A 5/1989 Schmidt
4,893,849 A 1/1990 Schlack
4,922,658 A 5/1990 Coddens
4,949,506 A 8/1990 Durham, Jr.
4,961,286 A 10/1990 Bezubic
5,072,464 A 12/1991 Draheim et al.
5,076,015 A 12/1991 Manzauni
5,087,087 A 2/1992 Vetter et al.
5,087,088 A 2/1992 Milam
5,090,750 A * 2/1992 Lindqvist ..... E05B 65/087 292/36
5,127,685 A 7/1992 Dallaire et al.
5,139,291 A 8/1992 Schultz
5,143,412 A 9/1992 Lindqvist
5,165,737 A 11/1992 Riegelman

(56) References Cited

U.S. PATENT DOCUMENTS 5,183,310 A 2/1993 Shaughnessy
5,244,238 A * 9/1993 Lindqvist ..... E05B 65/0841 292/36
5,274,955 A 1/1994 Dallaire et al.
5,341,752 A 8/1994 Hambleton
5,398,447 A 3/1995 Morse
5,437,484 A 8/1995 Yamada
5,454,609 A 10/1995 Slocomb et al.
5,560,149 A 10/1996 Lafevre
5,636,475 A 6/1997 Nidelkoff
5,653,485 A * 8/1997 Campbell ..... E05C 9/02 292/207
5,688,000 A 11/1997 Dolman
5,715,631 A 2/1998 Kailian et al.
5,791,700 A * 8/1998 Biro ..... E05C 9/043 292/36
5,829,196 A 11/1998 Maier
5,873,199 A 2/1999 Meunier et al.
5,901,499 A 5/1999 Delaske et al.
5,911,763 A 6/1999 Quesada
5,970,656 A 10/1999 Maier
5,992,907 A * 11/1999 Sheldon ..... E05D 15/22 292/141
6,086,121 A 7/2000 Buckland
6,135,510 A 10/2000 Diginosa
6,139,071 A 10/2000 Hopper
6,142,541 A 11/2000 Rotondi
6,155,615 A 12/2000 Schultz
6,161,335 A 12/2000 Beard et al.
6,176,041 B1 1/2001 Roberts
6,178,696 B1 1/2001 Liang
6,183,024 B1 2/2001 Schultz et al.
6,209,931 B1 4/2001 Stoutenborough et al.
6,217,087 B1 4/2001 Fuller
6,230,443 B1 5/2001 Schultz
6,257,303 B1 7/2001 Coubray et al.
6,279,266 B1 8/2001 Searcy
6,422,287 B1 7/2002 Wilke
6,546,671 B2 4/2003 Mitchell et al.
6,565,133 B1 5/2003 Timothy
6,588,150 B1 7/2003 Wong et al.
6,592,155 B1 7/2003 Lemley et al.
6,607,221 B1 8/2003 Elliott
6,631,931 B2 10/2003 Magnusson
6,817,142 B2 * 11/2004 Marshik ..... E05B 65/0835 292/DIG. 20
6,871,885 B2 3/2005 Goldenberg et al.
6,877,784 B2 * 4/2005 Kelley ..... E05B 53/003 292/141
6,957,513 B2 * 10/2005 Pettit ..... E05B 5/003 292/141
7,013,603 B2 3/2006 Eenigenburg et al.
7,070,211 B2 7/2006 Polowinczak et al.
7,070,215 B2 7/2006 Kelley
7,147,255 B2 12/2006 Goldenberg
7,322,619 B2 * 1/2008 Nolte ..... E05B 53/003 292/175
7,481,470 B2 1/2009 Polowinczak
7,490,873 B1 * 2/2009 Ricke ..... E05B 65/0876 292/5
7,607,262 B2 * 10/2009 Pettit ..... E05B 5/003 49/185
7,963,577 B2 * 6/2011 Wolf ..... E05C 3/046 292/241
7,976,077 B2 7/2011 Flory
8,272,164 B2 * 9/2012 Albrecht ..... E05B 17/2034 292/DIG. 20
8,550,507 B2 10/2013 Barton
8,789,857 B2 * 7/2014 Liang ..... E05B 17/2019 292/111
8,844,985 B2 * 9/2014 Liang ..... E05C 3/046 292/163
8,955,255 B2 * 2/2015 DeBoer ..... E05B 53/003 49/176
9,234,374 B2 * 1/2016 Wolf ..... E05C 3/046
2004/0168370 A1 * 9/2004 Pettit ..... E05B 5/003 49/185
2010/0132263 A1 * 6/2010 Flory ..... E05B 65/0841 49/395
2010/0218425 A1 9/2010 Nolte
2013/0214545 A1 8/2013 Wolf
2013/0283695 A1 10/2013 Hollermann

* cited by examiner

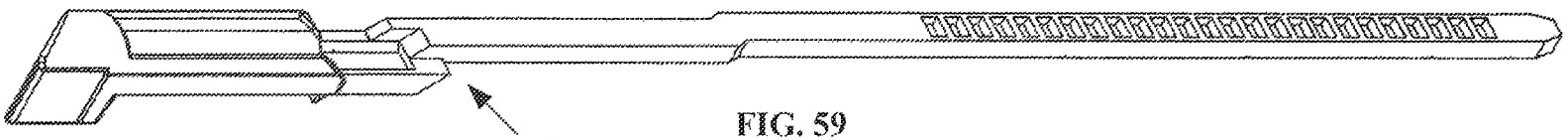
FIG. 59
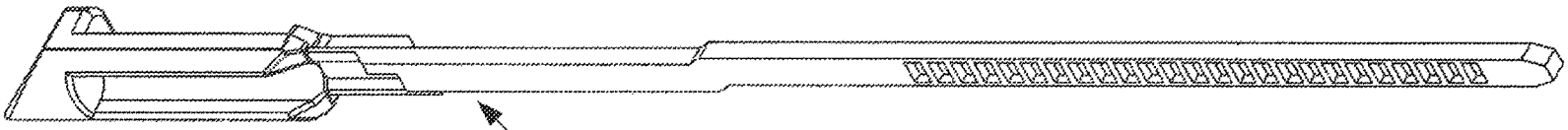
FIG. 60
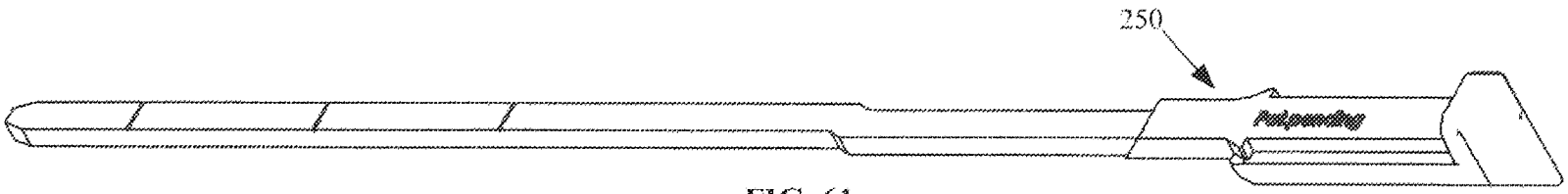
FIG. 61
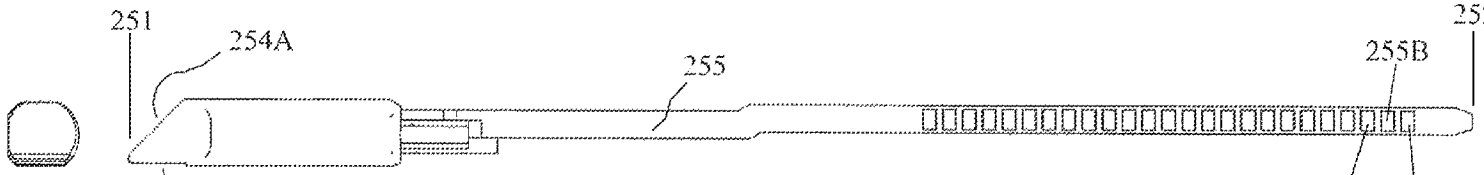
FIG. 62
FIG. 63
FIG. 64
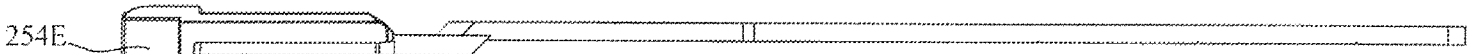
FIG. 65
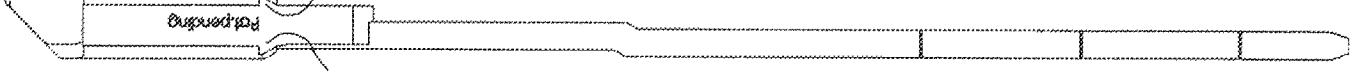
FIG. 66

INTEGRATED SASH LOCK AND TILT LATCH COMBINATION USING ONE LOCK FOR TWO TILT LATCHES

CROSS REFERENCE TO RELATED APPLICATIONS

This application is a continuation-in-part of U.S. patent application Ser. No. 14/566,908, filed on Dec. 11, 2014, having the title "Integrated Sash Lock and Tilt Latch Combination with Improved Wind-Force-Resistance Capability," which is a continuation-in-part of U.S. patent application Ser. No. 14/278,226, filed on May 15, 2014, having the title "Integrated Sash Lock and Tilt Latch Combination with improved Interconnection Capability Therebetween," which is a continuation-in-part of U.S. patent application Ser. No. 14/198,986, filed on Mar. 6, 2014, having the title "Integrated Sash Lock and Tilt Latch with Screwless Installation and Removal from Meeting Rail," with the disclosures of each being incorporated herein by reference.

FIELD OF THE INVENTION

The present invention relates to improvements in locks and tilt latches for slidable sash windows, and more particularly to improvements to an integral sash lock/tilt latch combination.

BACKGROUND OF THE INVENTION

Single hung and double hung sliding sash windows are commonly used today in the construction of residential and commercial buildings. Sash locks are typically mounted to the meeting rail of the bottom sash window to lock the sash or sashes, by preventing the lower sash (or both the lower and upper sashes for a double hung window), from being opened through sliding movement relative to the master window frame. Also, in order to assist in the cleaning of the exterior of these sliding sash windows, it is common for window manufacturers to incorporate a tilt latch device thereon that permits one end of the sliding sash window to be released from the track of the master window frame. This allows the sash window to be pivoted into the room, for easy access to the exterior surface of the glazing that is normally exposed to the exterior environment of the building.

The present invention seeks to provide improvements to such window hardware in the form of an integrated sash lock and tilt latch fastener for single hung or double hung windows.

OBJECTS OF THE INVENTION

It is an object of the invention to provide a sash lock to prevent relative sliding movement of one or both sliding sash windows that are slidable within a master window frame.

It is another object of the invention to provide a tilt latch to permit pivoting of a sliding sash window inwardly into the room in which the window is installed.

It is a further object of the invention to provide a combination sash lock and tilt latch that act cooperatively through the use of a single cam.

It is another object of the invention to provide a sash lock that may be actuated to simultaneously operate left-hand and right-hand tilt latch assemblies.

It is also an object of the invention to provide a sash lock that may be blindly coupled to a tilt latch device for cooperative interaction and actuation of the latch.

Further objects and advantages of the invention will become apparent from the following description and claims, and from the accompanying drawing figures.

SUMMARY OF THE INVENTION

An integral sash locking and tilt latching fastener for a sliding sash window includes a lock assembly and left-hand and right-hand latch assemblies, each of which may be interconnected with the lock assembly.

The lock assembly is mounted to the top of the meeting rail of the sash window. The lock assembly includes a housing and a cam pivotally mounted to the housing, being configured to pivot out from a cavity in the housing to releasably engage a keeper on the master window frame in a "lock" position, to lock the sash window and prevent it from sliding and/or tilting. The lock assembly also includes first and second lever arms each pivotally mounted to the lock housing, being configured for a portion of each arm to extend beyond the mounting surface of the housing, and into the hollow of the meeting rail. The cam may have a graspable shaft portion that protrudes upwardly, out from an orifice in the sash lock housing, to permit actuation of the device (cam rotation) by a user. Alternatively, the cam may have a separate handle member secured thereto, which may facilitate easy rotation and counter-rotation of the cam. A link selectively connects the two arms.

The left-hand and right-hand latch assemblies may be respectively received through an opening on the first and second sides of the sash member. The left-hand and right-hand latch assemblies may each include a housing, biasing means, and a latch member with an adjustable receiver clip having an opening therein configured to receive one of the arms of the lock assembly, when positioned within the hollow meeting rail. The housing, latch member, and biasing means are configured for the biasing means to normally bias the latch member so that a portion of one end (i.e., its "tongue") protrudes out from the housing, and out of the sash window frame.

With the cam in the "lock" position to prevent sliding of the sash window, the latch members are in the extended position which would prevent tilting of the sash window. When actuation of the cam/handle causes the can to rotate, it may drive the cam from the lock position into a first retracted position—a position where the cam is disengaged from the keeper on the master window frame, and the sash window is no longer prevented from sliding, but is nonetheless prevented from tilting by the latch members remaining in their extended position.

When continued actuation of the handle causes the cam to further rotate from the first retracted position into a second retracted position, the cam drives a first one of the arms to counter-rotate (i.e., to rotate in an opposite direction than the cam), with the connecting link causing the other arm to simultaneously rotate (i.e., to rotate in the same direction as the cam, but opposite to the rotation direction of the first arm). Movement of the cam into the second retracted position causes corresponding converging movement of the ends of the first and second arms (i.e., through the respective counter-rotation and rotation), which in turn causes the latch members of the first and second latch assemblies to each correspondingly move into the retracted position through the interconnection of the arms with the receiver clip of each latch assembly. Because of that interconnection, the biasing of each latch member back toward the extended position may also serve to simultaneously bias the first and second arms, and may bias the cam to move from the second retracted position back towards the first retracted position.

With the cam being actuated into, and held in, the second retracted position, so that the latch members of the latch assemblies are maintained in their retracted positions, the sash window is free to be tilted out of the master window frame.

BRIEF DESCRIPTION OF THE DRAWINGS

FIG. 59 is a first perspective view of a latch member used in the latch assembly of FIG. 1.

FIG. 60 is a second perspective view of the latch member shown in FIG. 59.

FIG. 61 is a third perspective view of the latch member shown in FIG. 59.

FIG. 62 is a top view of the latch member of FIG. 59.

FIG. 63 is a first end view of the latch member of FIG. 59.

FIG. 64 is a second end view of the latch member of FIG. 59.

FIG. 65 is a side view of the latch member of FIG. 59.

FIG. 66 is a bottom view of the latch member of FIG. 59.

Figure 116:
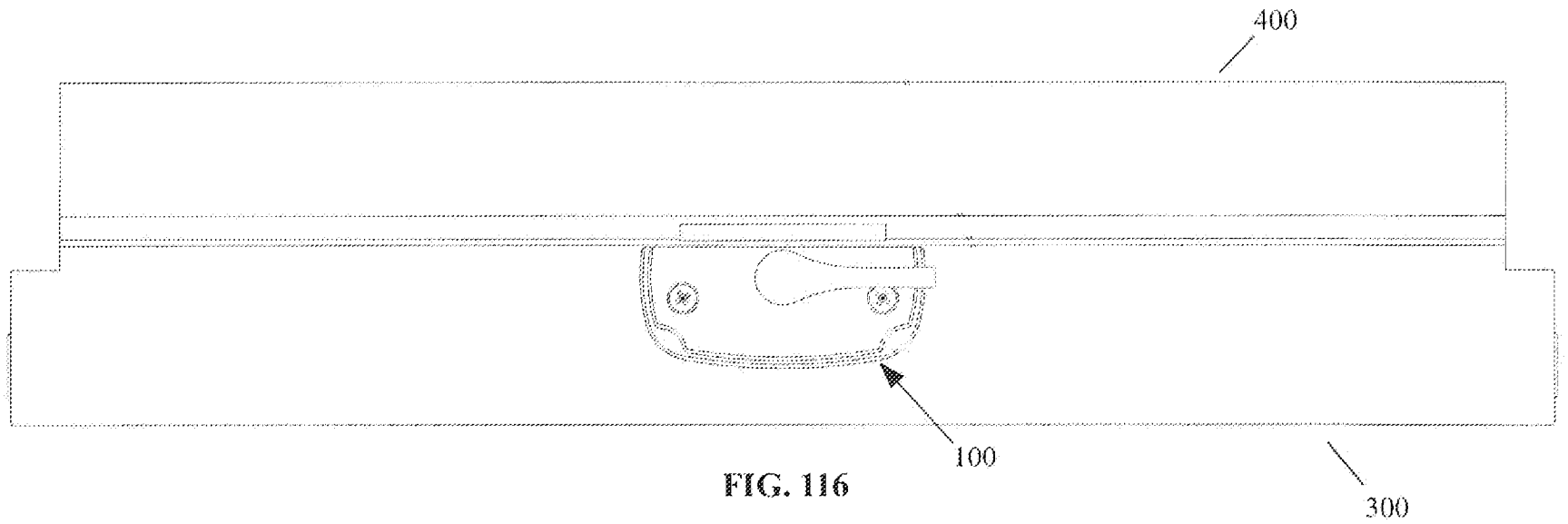
FIG. 116 is the top view of the window frame with the latch assemblies and the lock assembly installed thereon and mated together, as seen in FIG. 111, but shown with the integrated sash lock/tilt latch fastener in the unlocked and unlatched position with respect to the keeper on the master frame, so that it may tilt out from the master frame.
Figure 117:
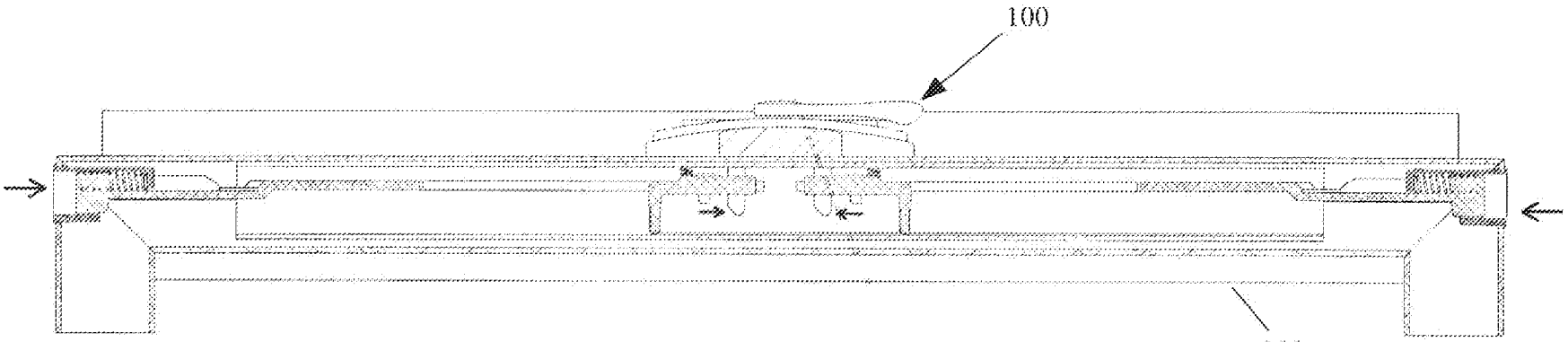
FIG. 117 is a front cross-sectional view of the window frame with the latch assemblies and the lock assembly installed thereon and mated together, as seen in FIG. 116.
Figure 118:
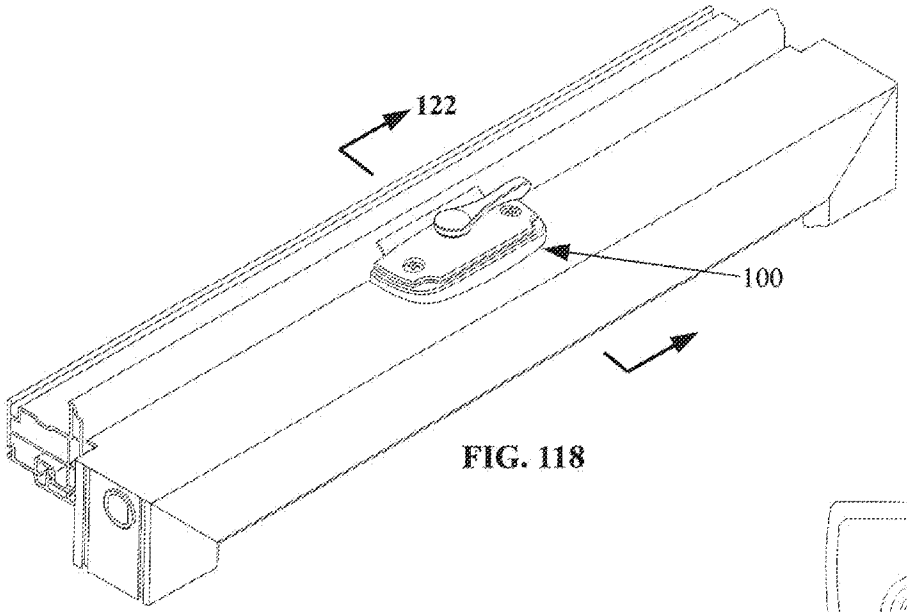

FIG. 118 a perspective view of the window frame with the latch assemblies and the lock assembly installed thereon and mated together, as seen in FIG. 116.

Figure 119:
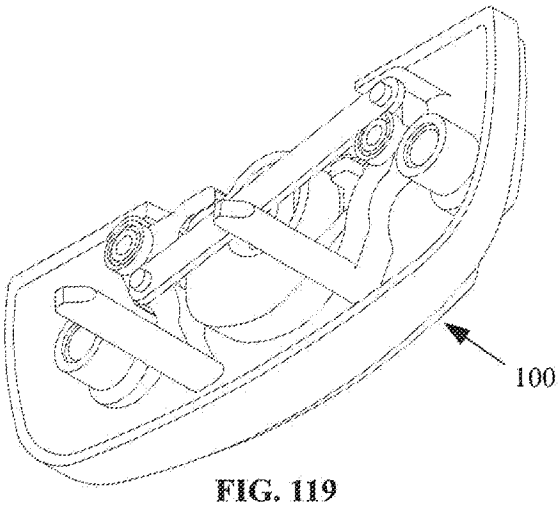

FIG. 119 is a bottom perspective view of the lock assembly as shown in FIG. 118, showing the positioning of its components, with the first and second lever arms shown in a converged position which caused the latch members to each move into the retracted position, for the integrated sash lock/tilt latch fastener to be in the unlocked and unlatched position.

Figure 120:
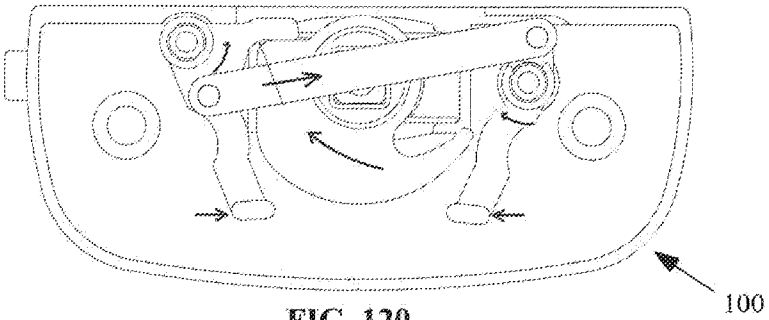

FIG. 120 is a bottom view of the lock assembly shown in FIG. 119.

Figure 121:
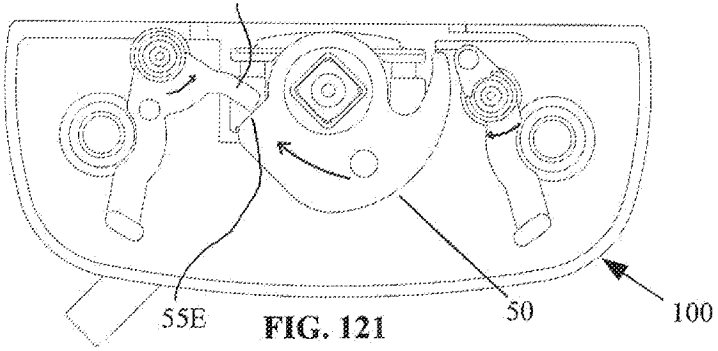

FIG. 121 is the bottom view of the lock assembly as shown in FIG. 120, but shown with the connecting link removed, and also shown with the first and second lever arms prior to moving into the converged position.

Figure 122:
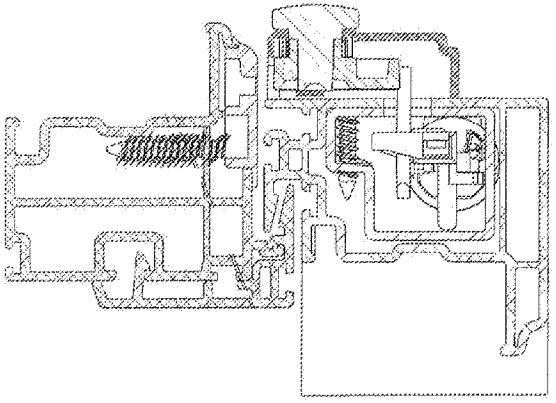

FIG. 122 is a cross-sectional view through the integrated sash lock/tilt latch fastener as installed and positioned in FIG. 118.

Figure 123:
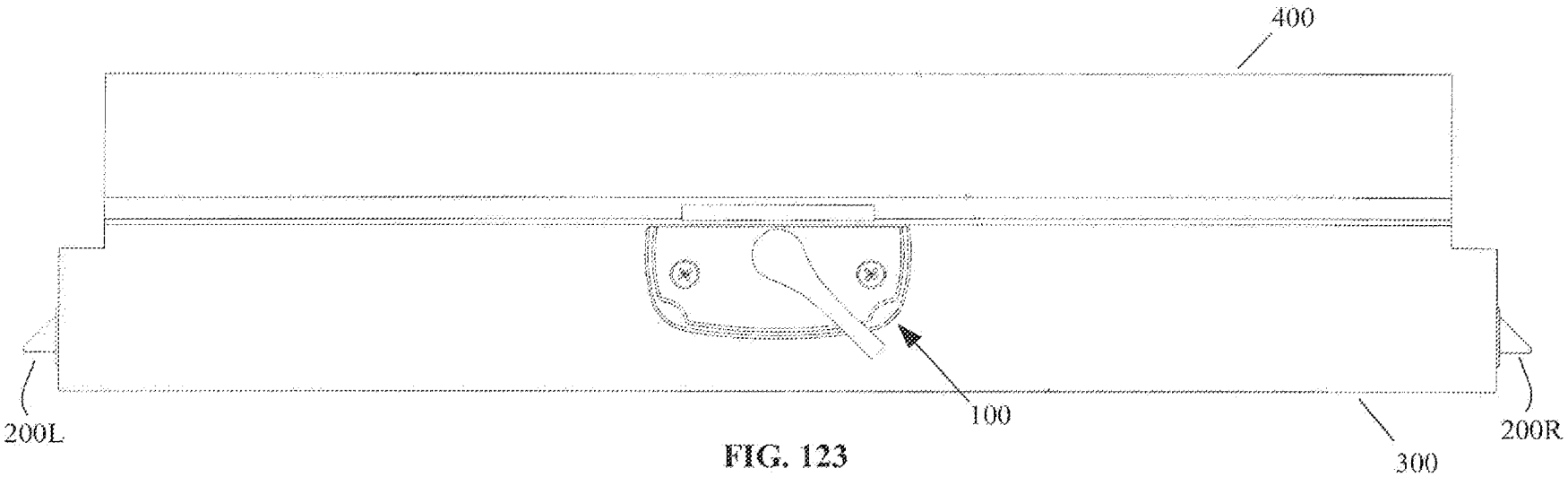

FIG. 123 is the top view of the window frame with the latch assemblies and the lock assembly installed thereon and mated together, as seen in FIG. 116, but shown with the handle of the integrated sash lock/tilt latch fastener having been released, for the fastener to be biased into the unlocked and latched position with respect to the keeper on the master frame.

Figure 124:
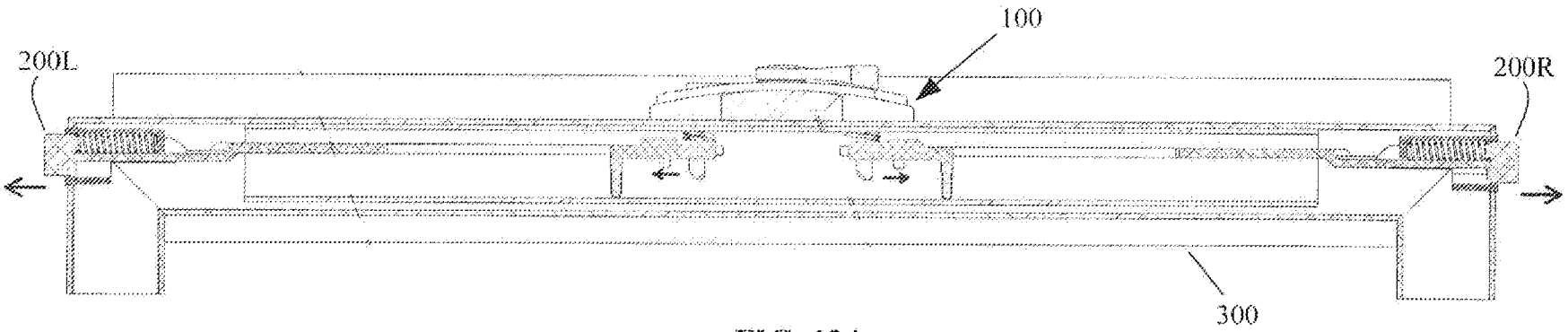

FIG. 124 is a front cross-sectional view of the window frame with the latch assemblies and the lock assembly installed thereon and mated together, as seen in FIG. 123.

Figure 125:
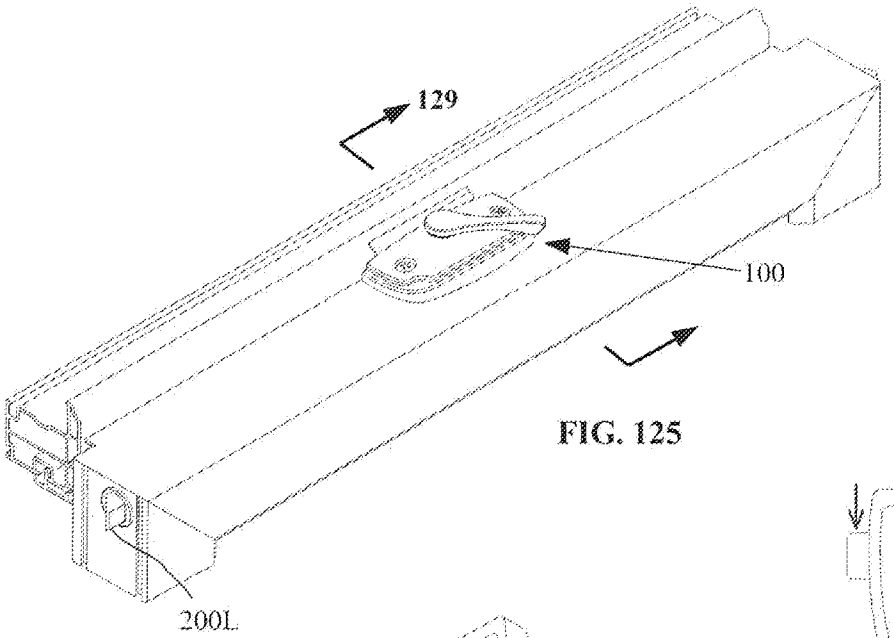

FIG. 125 a perspective view of the window frame with the latch assemblies and the lock assembly installed thereon and mated together, as seen in FIG. 123.

Figure 126:
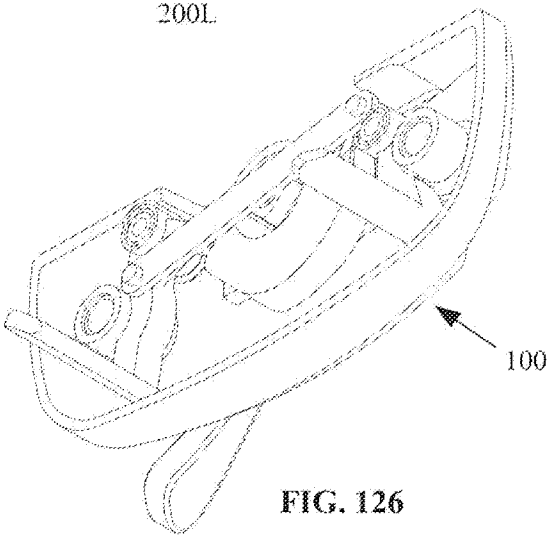

FIG. 126 is a bottom perspective view of the lock assembly as shown in FIG. 125, showing the positioning of its components, with the first and second lever arms shown in a diverged position in which the latch members are each biased into the extended position, for the integrated sash lock/tilt latch fastener to be in the unlocked and latched position.

Figure 127:
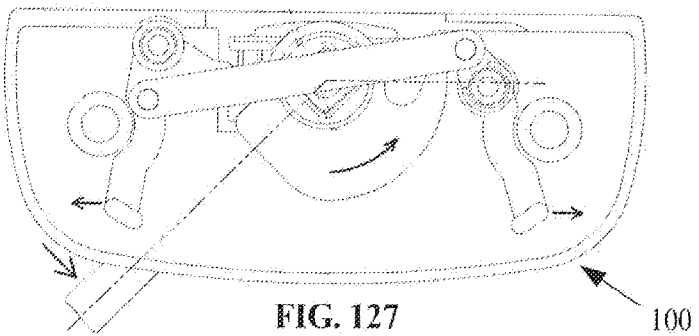

FIG. 127 is a bottom view of the lock assembly shown in FIG. 126.

Figure 128:
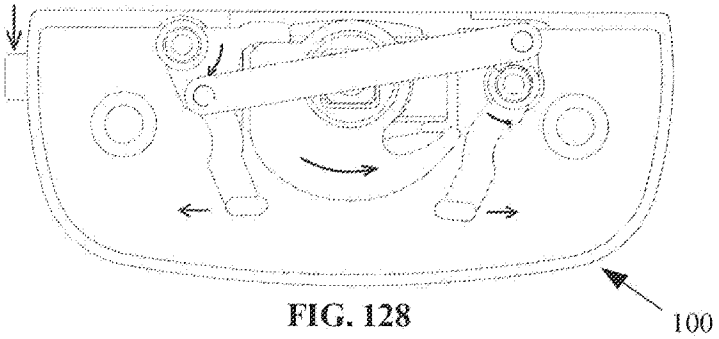

FIG. 128 is the bottom view of the lock assembly as shown in FIG. 127, but shown with the first and second lever arms prior to moving into the diverged position.

Figure 129:
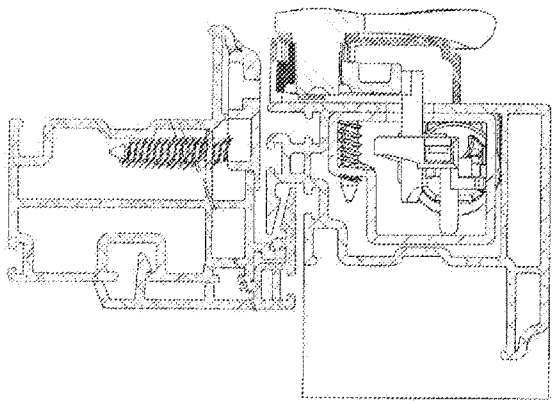

FIG. 129 is a cross-sectional view through the integrated sash lock/tilt latch fastener as installed and positioned in FIG. 125.

DETAILED DESCRIPTION OF THE INVENTION

Figure 1:
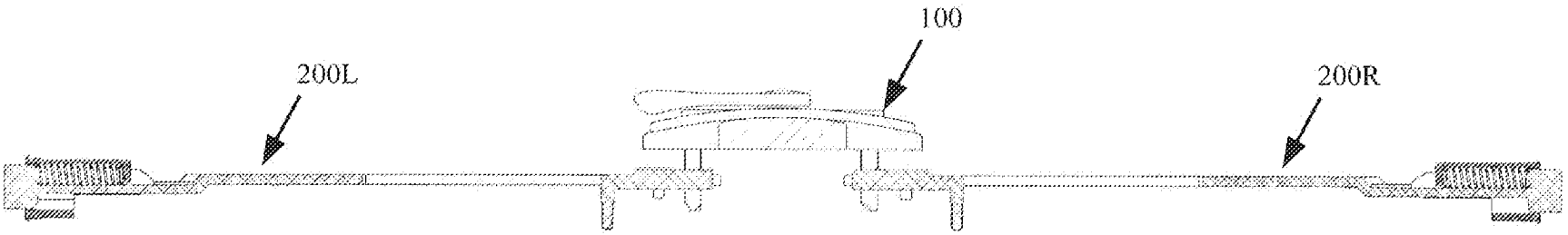
FIG. 1 is a cross-sectional side view of a sash fastener for a slidable sash member, and includes a sash lock assembly and left-hand and right-hand tilt latch assemblies.

FIG. 1 shows an embodiment of the Applicant's integrated sash lock/tilt latch fastener, which may be used in conjunction with a sash window that is designed to be slidable and tiltable with respect to a master window frame.

The integrated, sash lock/tilt latch fastener of FIG. 1 may include a left-band latch assembly 2001, and right-hand latch assembly 200R, and a lock assembly 100, which may be blindly mated to the latch assemblies during its installation upon the meeting rail of the sash window.

Figure 2B:
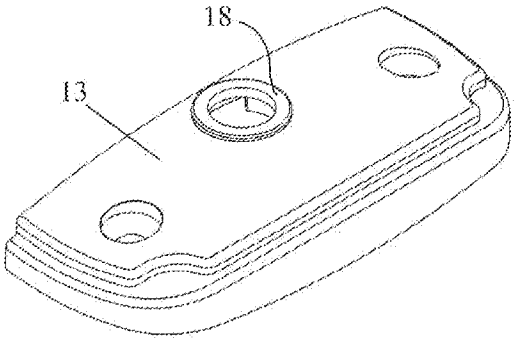
FIG. 2B is a second perspective view showing the exterior of the housing of FIG. 2.
Figure 2A:
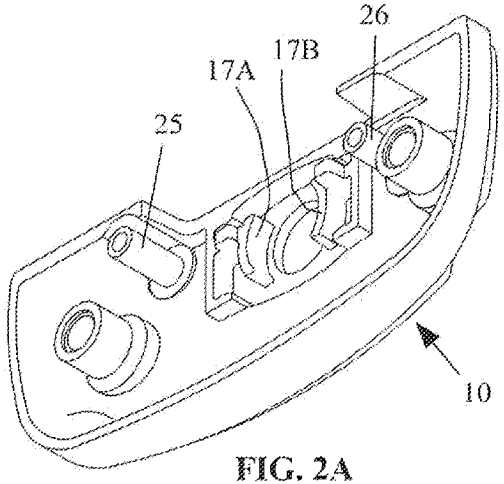
FIG. 2A is a first perspective view showing the interior of a housing that may be used to house the component parts of the sash lock assembly of FIG. 1.
Figure 5:
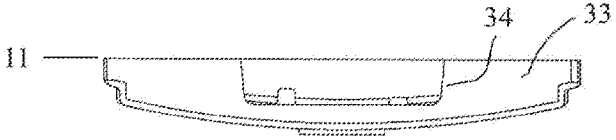
FIG. 5 is a front view of the sash lock housing of FIG. 2.
Figure 3:
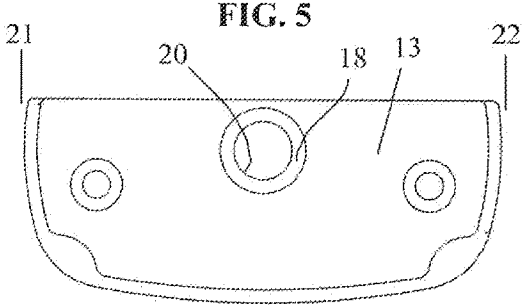
FIG. 3 is a top view of the sash lock housing of FIG. 2.
Figure 6:
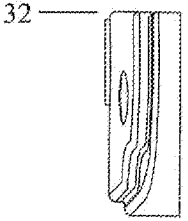
FIG. 6 is a first end view of the sash lock housing of FIG. 2.
Figure 4:
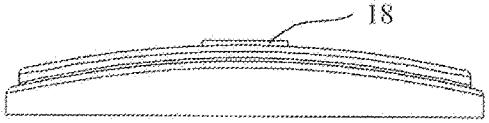
FIG. 4 is a rear view of the sash lock housing of FIG. 2.
Figure 7:
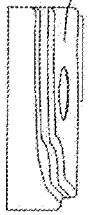
FIG. 7 is a second end view of the sash lock housing of FIG. 2.
Figure 8:
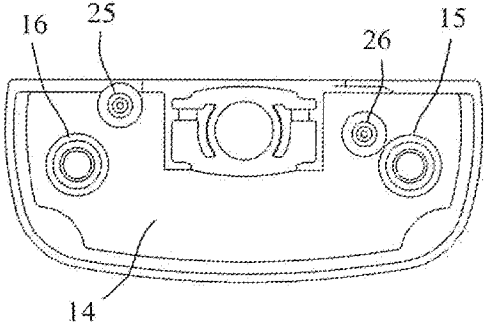
FIG. 8 is a bottom view of the sash lock housing of FIG. 2.
Figure 9:
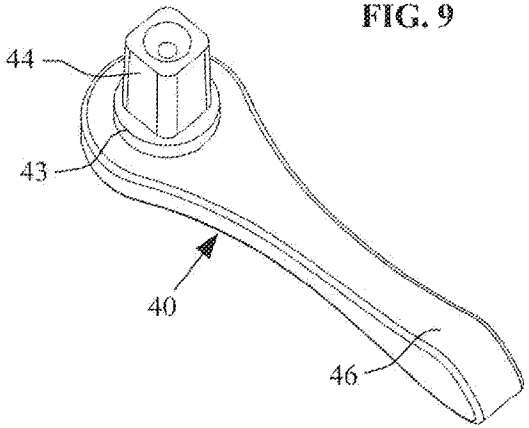
FIG. 9 is a first perspective view of the shaft/handle member of the sash lock assembly of FIG. 1.
Figure 10:
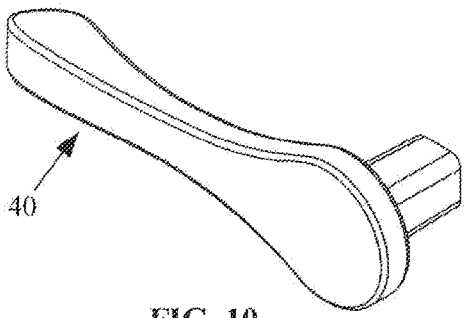
FIG. 10 is a second perspective view of the shaft/handle member of the sash lock assembly of FIG. 1.
Figure 11:
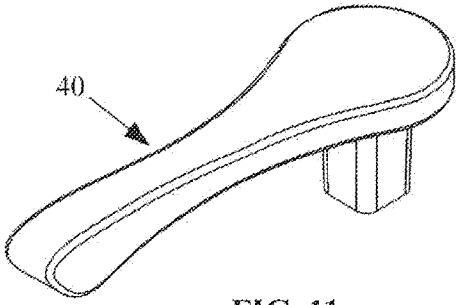
FIG. 11 is a third perspective view of the shaft/handle member of the sash lock assembly of FIG. 1.
Figure 15:
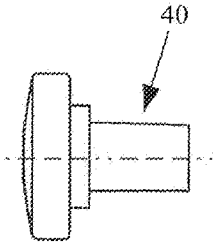
FIG. 15 is an end view of the shaft/handle member of FIG. 9.
Figure 14:
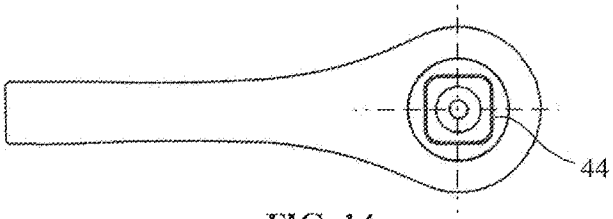
FIG. 14 is a top view of the shaft/handle member of FIG. 9.
Figure 12:
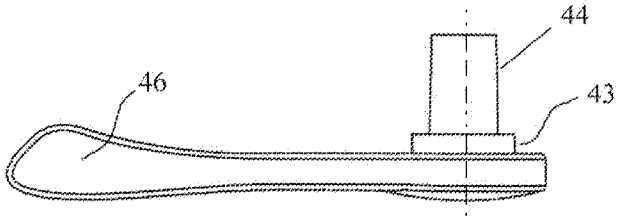
FIG. 12 is a side view of the shaft/handle member of FIG. 9.
Figure 13:
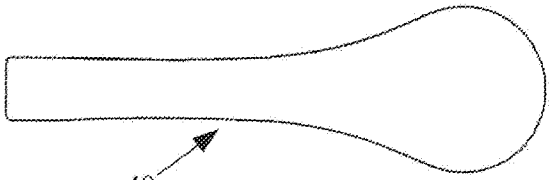
FIG. 13 is a bottom view of the shaft/handle member of FIG. 9.
Figure 18:
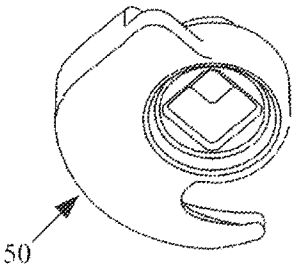
FIG. 18 is a third perspective view of the cam of the sash lock assembly of FIG. 16.
Figure 22:
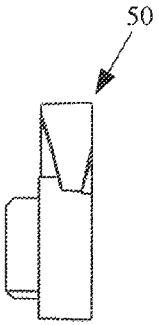
FIG. 22 is a first end view of the locking cam of FIG. 16.
Figure 17:
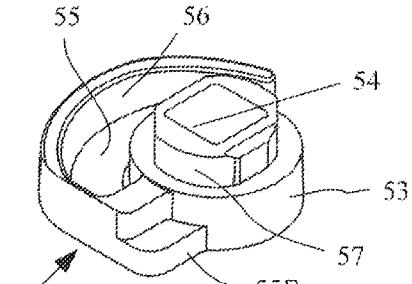
FIG. 17 is a second perspective view of the can of the sash lock assembly of FIG. 16.
Figure 21:
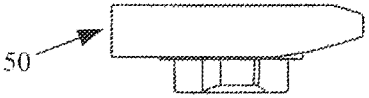
FIG. 21 is a second side view of the locking cam of FIG. 16.

Perspective views of the housing 10 of the sash lock assembly 100 are shown in FIGS. 2A and 2B, while corresponding orthogonal views are shown in FIGS. 3-8. The housing 10 is not limited to the shape illustrated within FIGS. 3-8, and could take on many different appropriate shapes, including a rectangular shape, an irregular shape, etc. However, the housing 10 may be desirably shaped to have a generally curved outer surface 13, spanning from a first end 21 to second end 22. The curvature of surface 13 may terminate at a generally flat bottom surface 11. The curvature of surface 13 may also transition, as seen in FIG. 6, into a generally flat surface 32, at which a wall 33 may be formed (FIG. 5). The housing 10 may be hollowed to form an interior surface 14, and the wall 33 may have an opening 34 into the interior cavity of the housing.

Extending outwardly from the interior surface 14 of the housing 10 may be at least one hollow cylindrical protrusion that may be used to secure the sash lock assembly 100 to the sash window. In one embodiment of the housing, two hollow cylindrical protrusions 15 and 16 are used, and each may be configured to respectively receive a screw for mounting of the sash lock 100 to the sash window.

Extending outwardly from the interior surface 14 of the housing 10 may also be a first shaft 25 and a second shaft 26, which may be used for pivotal mounting of a pair of lever arms.

The housing 10 may have a cylindrical boss 18 extending upwardly from the outer surface 13, and may also have a cylindrical boss extending downwardly from the interior surface 14, into the housing cavity. Cylindrical boss 18 may have a through-hole 20 positioned therein. The hole 20 may be used for pivotal mounting of a shaft that extends from a locking cam, or alternatively, the hole 20 may be used for pivotal mounting of a separate shaft/handle member, to which the locking cam may instead be fixedly secured.

In the embodiment illustrated herein, as seen in FIGS. 9-15, a shaft member 40 may have a cylindrical shaft 43, one end of which may have a keyed protrusion 44 extending therefrom, with an orifice therein. The other end of the shaft 43 may have a graspable handle portion 46 that extends generally orthogonally with respect to the axis of shaft 43. The shaft 43 may be configured to be received through the hole 20 in the boss 18 of the housing 10. The keyed protrusion 44 may be any suitable cross-sectional shape, and in this example, the keyed protrusion is formed using a rectangular shape.

The locking cam 50 illustrated in FIGS. 16-24 may have a cylindrical hub 53, with a keyed opening 54 that is shaped to match the keyed protrusion 44 of the shaft member 40. Extending laterally away from the hub 53 may be a wall 55, and extending away from the wall 55 may be a curved cam wall 56, which may be used to engage the key of the corresponding keeper, and draw the sliding sash window in closer proximity to the master window frame (or to the other sash window for a double-hung arrangement). The wall 55 may terminate at an engagement surface 55E, which may be generally flat.

Protruding away from the hub 53 may be a cylindrical member 57, which may be generally concentric with the hub. The cylindrical member 57 may have a first flat 58A formed thereon, and a second flat 58B formed thereon to be clocked 180 degrees away from the first flat 58A. The flats 58A and 58B may operate as a detent to releasably secure the cam 50, at an extended (lock) position and at a retracted (unlocked) position, with respect to the leaf spring 90 (FIG. 45), which is discussed hereinafter with respect to FIGS. 106-108 and FIGS. 112-115.

Figure 19:
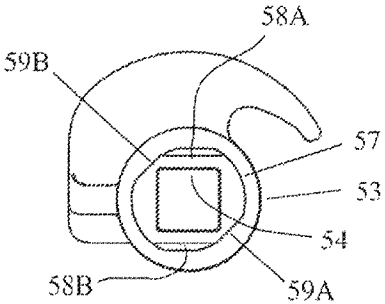
FIG. 19 is a top view of the locking cam of FIG. 16.
Figure 20:
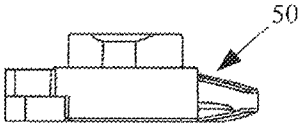
FIG. 20 is a first side view of the locking cam of FIG. 16.
Figure 23:
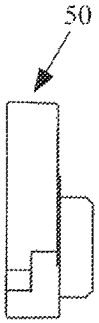
FIG. 23 is a second end view of the locking cam of FIG. 16.
Figure 16:
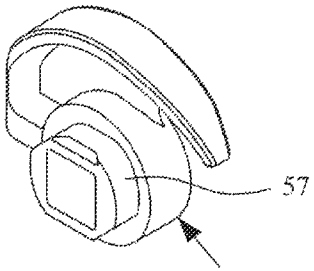
FIG. 16 is a first perspective view of the cam of the sash lock assembly of FIG. 1.
Figure 24:
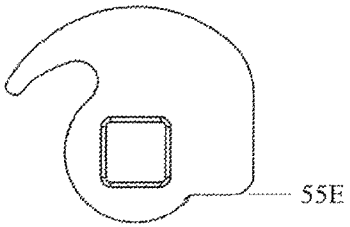
FIG. 24 is a bottom view of the locking cam of FIG. 16.
Figure 28:
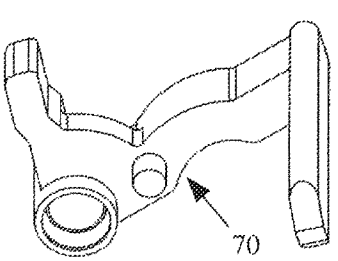
FIG. 28 is a fourth perspective view of the lever arm of FIG. 25.
Figure 27:
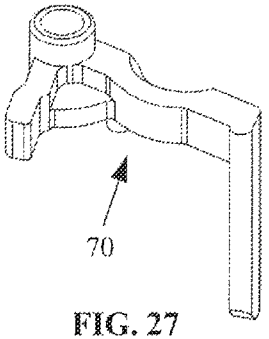
FIG. 27 is a third perspective view of the lever arm of FIG. 25.
Figure 31:
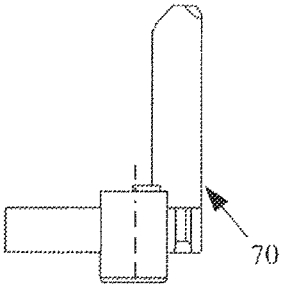
FIG. 31 is a second side view of the lever arm of FIG. 25.
Figure 26:
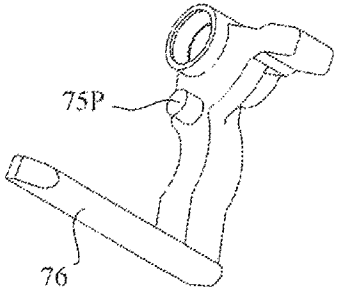
FIG. 26 is a second perspective view of the lever arm of FIG. 25.
Figure 25:
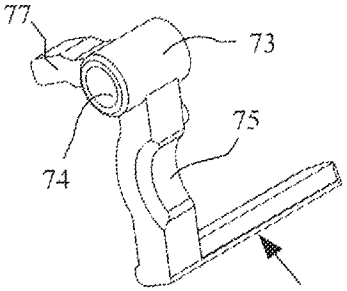
FIG. 25 is a first perspective view of the first lever arm of the sash lock assembly of FIG. 1.
Figure 32:
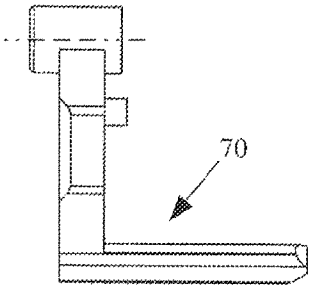
FIG. 32 is a first end view of the lever arm of FIG. 25.
Figure 29:
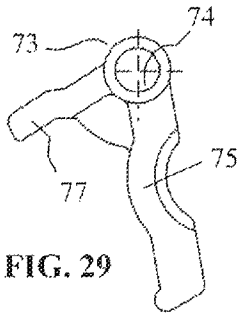
FIG. 29 is a top view of the lever arm of FIG. 25.
Figure 30:
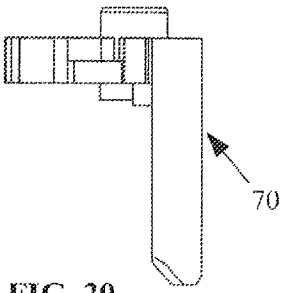
FIG. 30 is a first side view of the lever an of FIG. 25.
Figure 33:
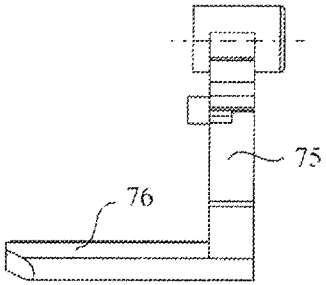
FIG. 33 is a second end view of the lever arm of FIG. 25.
Figure 34:
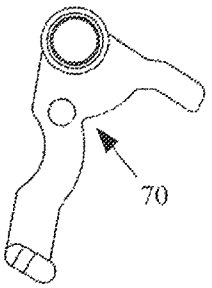
FIG. 34 is a bottom view of the lever arm of FIG. 25.
Figure 38:
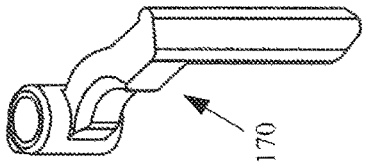
FIG. 38 is a fourth perspective view of the lever arm of FIG. 35.
Figure 37:
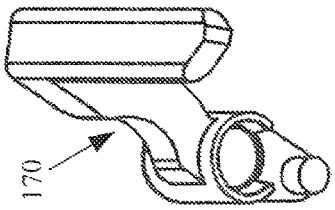
FIG. 37 is a third perspective view of the lever arm of FIG. 35.
Figure 42:
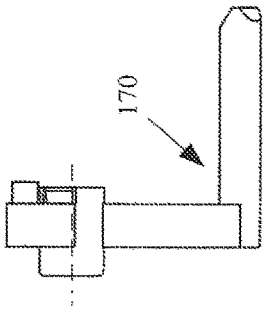
FIG. 42 is the first end view of the lever arm of FIG. 35.
Figure 41:
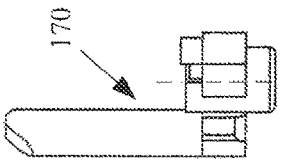
FIG. 41 is a second side view of the lever arm of FIG. 35.
Figure 39:
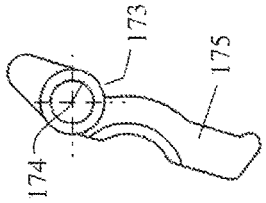
FIG. 39 is a top view of the lever arm of FIG. 35.
Figure 40:
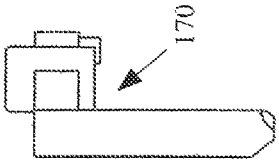
FIG. 40 is a first side view of the lever arm of FIG. 35.
Figure 36:
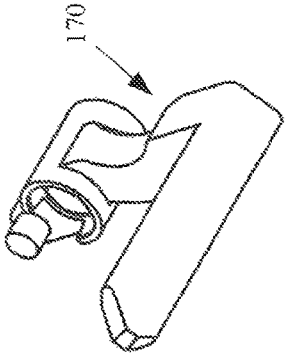
FIG. 36 is a second perspective view of the lever arm of FIG. 35.
Figure 43:
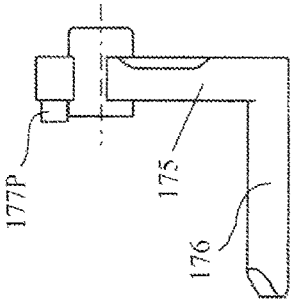
FIG. 43 is the second end view of the lever arm of FIG. 35.
Figure 35:
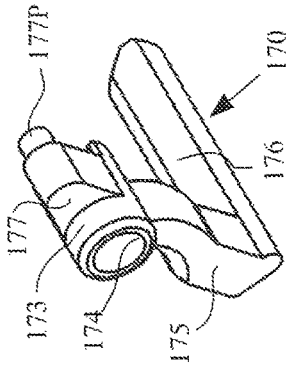
FIG. 35 is a first perspective view of the second lever arm of the sash lock assembly of FIG. 1.
Figure 44:
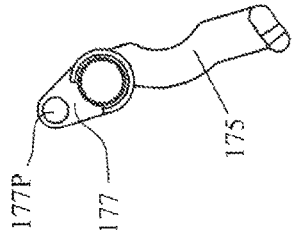
FIG. 44 is the bottom view of the lever arm of FIG. 35.

The cylindrical member 57A may also have a third flat 59A formed thereon, as seen in FIG. 19, at a position that is clocked roughly 135 degrees from the first flat 58A. The flat 59A may also operate as a detent, and may releasably secure the cam 50 with respect to the leaf spring 90, at another sash unlocked position, which will be termed herein, with respect to the operation of the sash lock, as a second unlock position. For greater stability of the cam in being releasably retained at the second unlocked position, a fourth flat 59B may be positioned on the cylindrical member 57 at a position that is clocked roughly 180 degrees from the third flat 59A, which may releasably engage a second leaf spring. Note that the flats could be formed on the cylindrical hub 53, instead of on the protruding cylindrical member 57.

Interaction between the sash lock assembly 100 with the latch assemblies 200L/200R, once installed upon the meeting rail of the sliding sash window, may be through the use of a first lever arm 70 and second lever arm 170, each of which may be pivotally mounted to the housing 10.

The lever arm 70 is shown in detail within FIGS. 25-34. Lever arm 70 may include as hub 73, with a generally concentric mounting hole 74 therein. Extending laterally away from the axis of the hub 73 may be a first arm member 75. The first arm member 75 may transition into a post 76 that may be generally orthogonal to the arm member 75 and may be generally parallel to the axis of the hub 73. A cylindrical protrusion 75P may protrude away from the arm 75, in proximity to the hub 73, and it may protrude in the same direction as the post 76. A second arm member 77 may also extend laterally away from the axis of the hub 73.

The second lever arm 170 is shown in detail within FIGS. 35-44. Lever arm 170 may include a hub 173, with a generally concentric mounting hole 174 therein. Extending laterally away from the axis of the hub 173 may be a first arm member 175. The first arm member 175 may transition into a post 176 that may be generally orthogonal to the arm member 175 and may be generally parallel to the axis of the hub 173. A second arm member 177 may also extend laterally away from the axis of the hub 73, and may extend away from the hub on an opposite side of the hub as does the arm 175. A cylindrical protrusion 177P may protrude away from the arm 177, in proximity to the hub 173, and it may protrude in the same direction as the post 176.

Figure 46B:
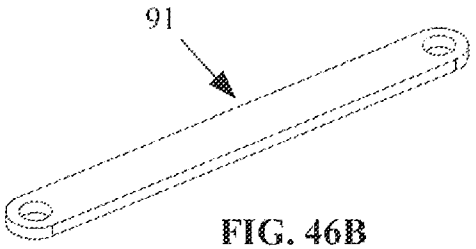
FIG. 46B is a second perspective view of the connecting link of FIG. 46A.
Figure 46A:
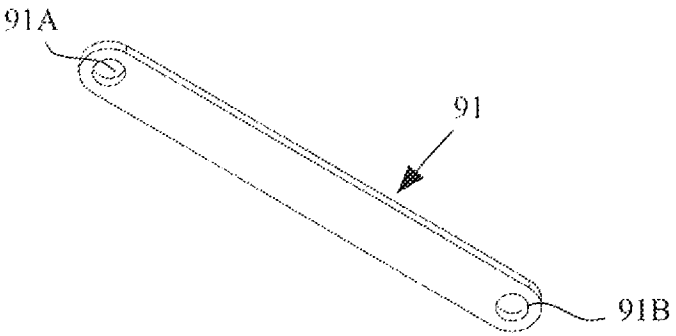
FIG. 46A is a first perspective view of the connecting link of the lock assembly of FIG. 1.
Figure 45:
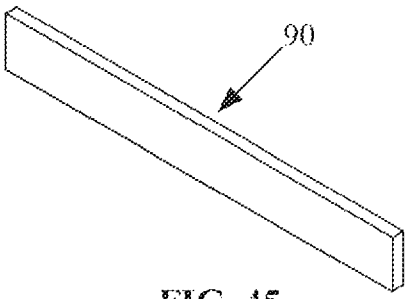
FIG. 45 is a perspective view of the leaf spring of the sash lock assembly of FIG. 1.

The remaining component parts that may be used for sash lock 100 are the leaf spring 90 shown in FIG. 45, and the connecting link 91 shown in FIGS. 46A and 46B. The connecting link 91, as seen therein, may have a first hole 91A and a second hole 91B at opposite ends of the link.

Figure 47:
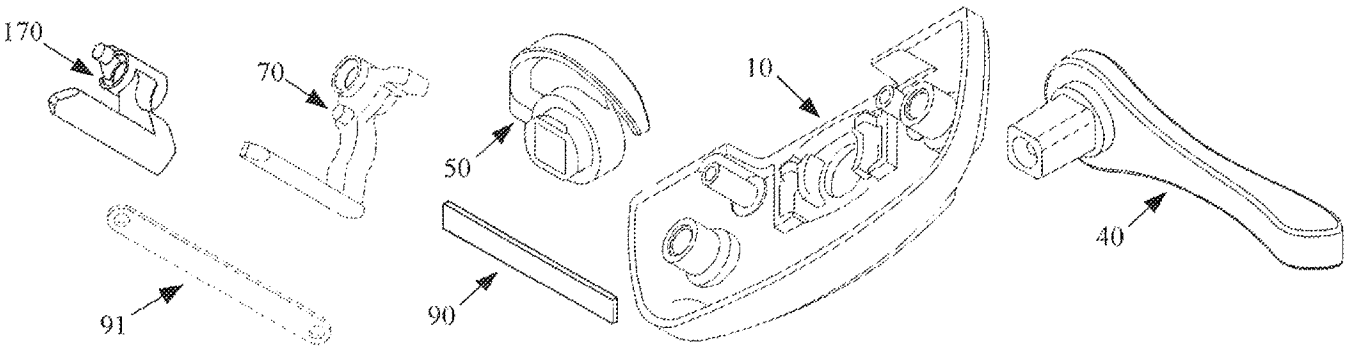
FIG. 47 is an exploded view of the component parts used for the sash lock assembly of FIG. 1, and includes the housing, the shaft/handle member, the cam, the first lever arm, the second lever arm, the detent spring and the connecting link detailed in the previous figures.

All of the component parts used for sash lock assembly 100 are shown in the exploded view of FIG. 47.

Figure 48:
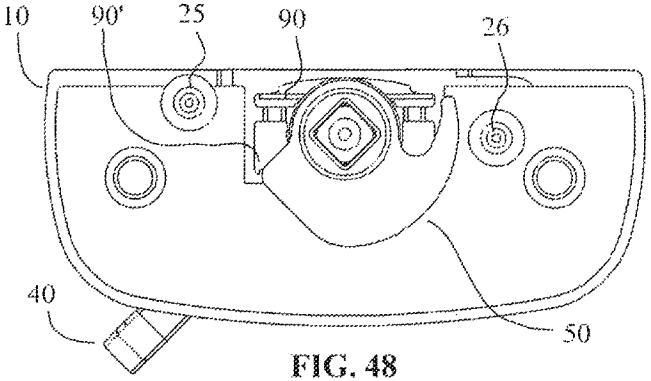
FIG. 48 is a bottom view of the housing of the latch assembly of FIG. 1, shown with two detent springs and the cam installed therein, and with the shaft/handle member fixedly secured to the cam.

Initial assembly of sash lock assembly 100 is shown in FIG. 48. The leaf spring 90, which may be a generally flat elongated flexible member, may be installed into the housing interior. The ends of leaf spring 90 may be fixedly received within a pair of corresponding recesses in the housing, using a friction fit, or using adhesive, or mechanical fasteners, etc. As mentioned above, a second leaf spring 90' may be used, and may similarly be secured within the housing cavity, to be at a distance away from the first leaf spring that is roughly the same as the distance between the pair of flats 58A and 58B, which may be roughly the same as the distance between the pair of flats 59A and 59B.

The cylindrical shaft 43 of the shaft/handle member 40 may then be pivotally received in hole 20 of housing 10. The locking cam 50 may be joined to the shaft/handle member 40, with the keyed protrusion 44 of the shaft member 40 being received within the keyed opening 54 of locking cam 50, and being secured thereat using a friction fit, adhesive, mechanical fasteners, or by being welded thereto, or by using any combination of such suitable means of securing two part together. Note that additional pivotal support for the cam 50 may be provided by the curved housing walls 17A and 17B (FIG. 2A) pivotally receiving the hub 53 of the cam therein.

Figure 49:
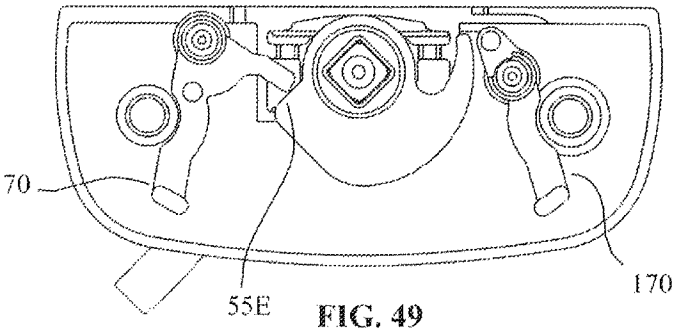
FIG. 49 is the bottom view of FIG. 48, but shown with the first lever arm and the second lever arm pivotally installed therein.

Next, as seen in FIG. 49, the hole 74 of the hub 73 of the first lever arm 70, and the hole 174 of the hub 173 of the second lever arm 170 may be pivotally received upon the shaft 25 and shaft 26 of the housing, respectively. To pivotally secure the lever arms 70 and 170 thereto, the end of each shaft 25/26 may be bucked like a rivet, to form a manufactured head to prevent the lever arm from slipping off of the post. Alternatively, a screw or other mechanical fastener may be used for pivotally securing the hubs 73/173 of the lever arms 70/170 to the shafts 25/26 of the housing 10.

Figure 50:
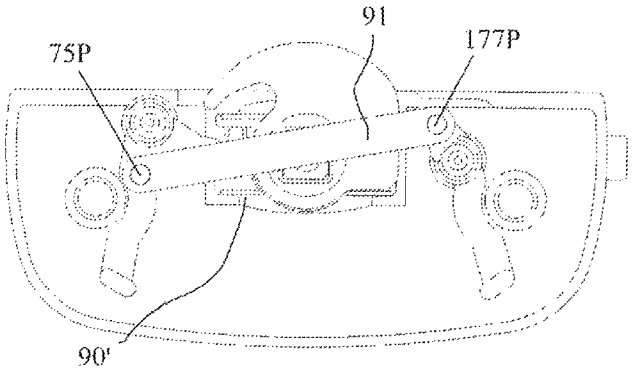
FIG. 50 is the bottom view of FIG. 49, but shown with the connecting link pivotally coupled to each of the first lever arm and the second lever arm to form the lock assembly.
Figure 51:
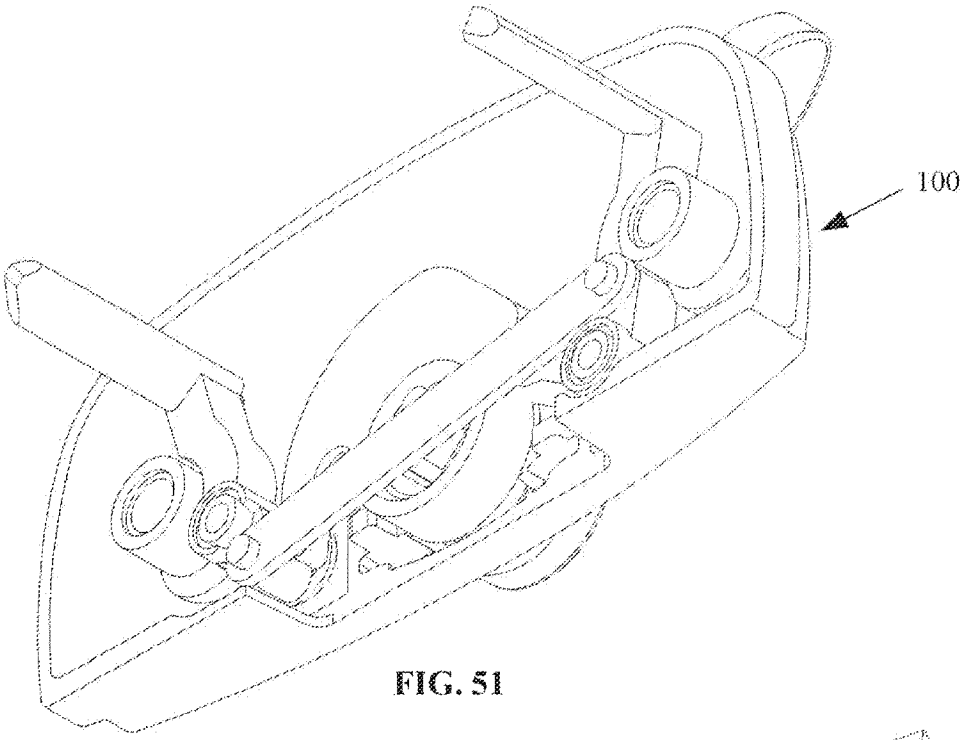
FIG. 51 is a first perspective view of the lock assembly of FIG. 50.
Figure 52:
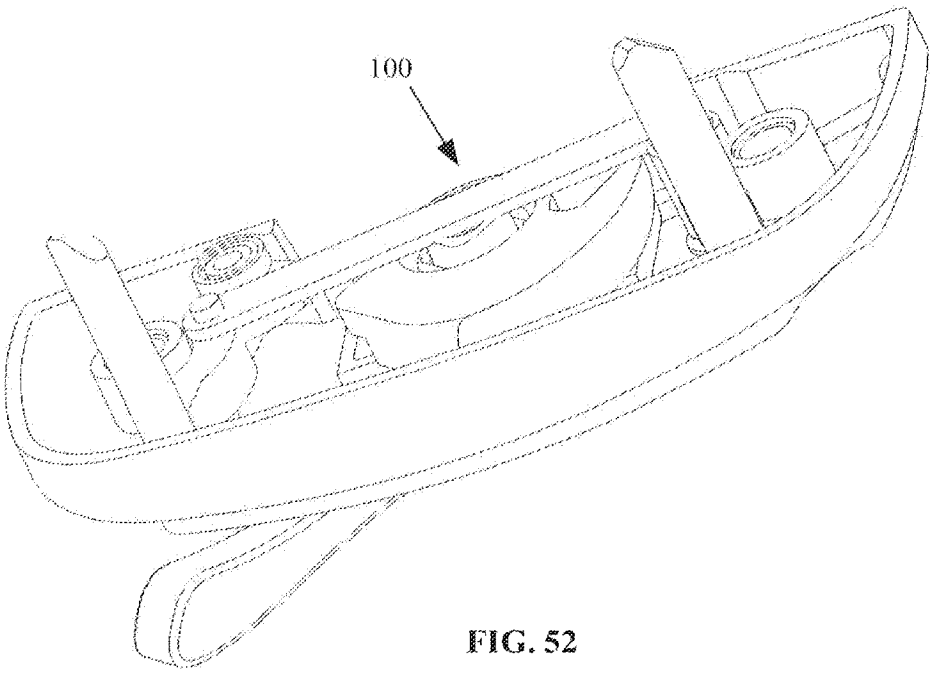
FIG. 52 is a second perspective view of the lock assembly of FIG. 50.
Figure 54:
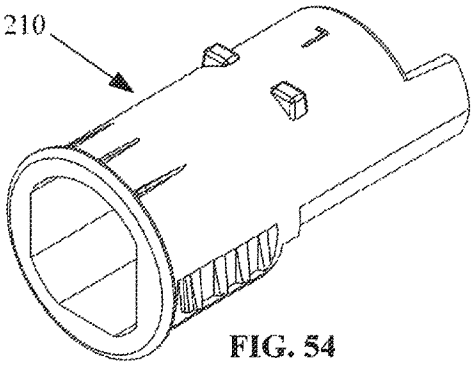
FIG. 54 is a second perspective view of the housing shown in FIG. 53.
Figure 57:
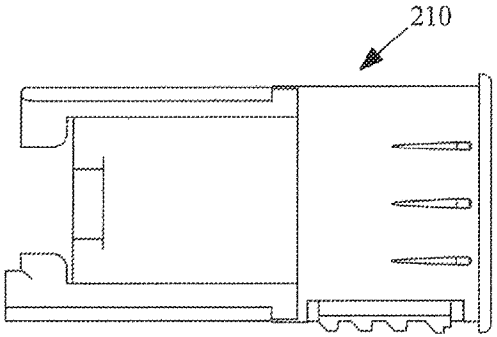
FIG. 57 is a second side view of the latch housing of FIG. 53.
Figure 55:
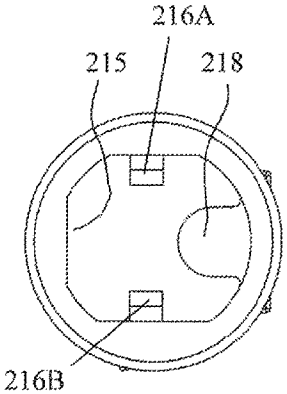
FIG. 55 is an end view of the latch housing of FIG. 53.
Figure 53:
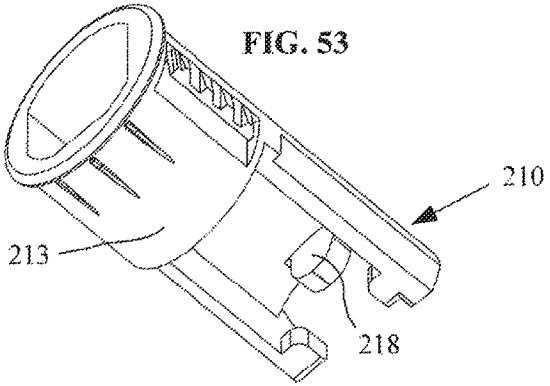
FIG. 53 is a first perspective view of a housing used to house the component parts of the left-hand latch assembly of FIG. 1.
Figure 56:
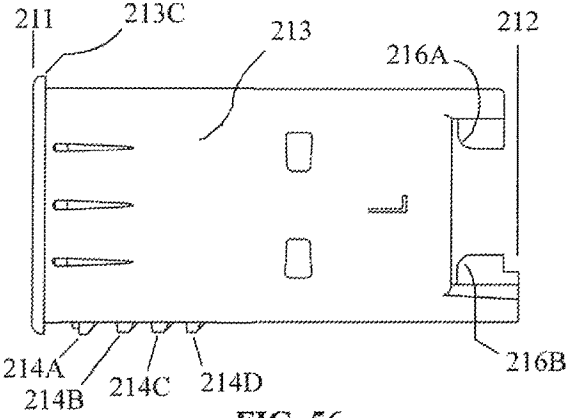
FIG. 56 is a first side view of the latch housing of FIG. 53.

Lastly, as seen in FIG. 50, the connecting link 91 may be used to couple to the pivotal motion of the first lever arm 70 to the second lever arm 170. The hole 91A of the connecting link 91 may be received upon the cylindrical protrusion 75P of the first lever arm 70, and the hole 91B of the connecting link may be received upon the cylindrical protrusion 177P of the second lever arm 170. The connecting link 91 may be retained thereon by bucking the end of each protrusion, or by using a mechanical fastener, etc.

Therefore, as may be understood by viewing FIG. 49 and FIG. 50, when the shaft/handle member 40 is rotated for the cam to be in the locked position (i.e., protruding from the housing as in FIG. 50, where it would engage the key of a keeper to secure the sliding sash window from sliding within the track of the master window frame), the lever arms are unaffected by the cam (although they may be biased by the latch assemblies, as discussed hereinafter).

When the shaft/handle member 40 is rotated for the cam to be in the first unlock position shown in FIG. 49 (to permit sash window to slide in the master window frame), the cam may only just come into contact with the engagement surface 55E of wall 55 of the cam, and the lever arms may otherwise remain unaffected by the cam rotation.

However, as the shaft/handle member 40 is rotated further for the cam to move from the first unlock position (FIG. 49 and FIG. 121) to the second unlock position (FIG. 120), the engagement surface 55E of wall 55 of the cam contacts and drives the second arm member 77 of the first lever arm 70, causing it to counter-rotate (i.e., to rotate in an opposite direction). With the connecting link 91 coupling the first lever arm 70 to the second lever arm 170, as the first lever arm is thereby caused to counter-rate by the cam 50, the link drives the second lever arm to rotate (i.e., to rotate opposite from the rotation of the first lever arm). Therefore, movement of the shaft 40 and cam 50 between these two unlock position may cause corresponding movement of the latch members of the latch assemblies, as discussed hereinafter.

The clocking of the flat 58A and flat 58B on the cylindrical member 57 on the hub 53 of locking cam 50 may respectively contact and be flush with the leaf springs 90 and 90', to releasably restrain the locking cam 50 from rotating out of the locked position, without being deliberately moved therefrom.

Also, the clocking of the flat 59A and flat 59B of the cylindrical member 57 on the hub 53 of locking cam 50 may respectively contact and be flush with the flexible leaf springs 90 and 90' when the cam is at the first unlocked position of the locking cam 50. (Note, to increase flexibility of the leaf springs 90 and 90', only one end of each spring may be fixedly mounted in the housing, or alternatively, both ends may be slidably mounted therein, to easily permit lateral deflection of the leaf springs, but without permitting them to become loosened or disconnected from proper positioning within the housing adjacent to the locking cam).

This contact of the flats of the cam with the leaf spring may serve to releasably restrain the locking cam 50 from rotating out of the first unlocked position, without being deliberately moved therefrom. Note that since the angle at which the flats 58A/58B were clocked from the flats 59A/59B was approximately 135 degrees, the shaft/handle 40 will need to rotate approximately 135 degrees to actuate the sash lock assembly 100 from the locked position to the first unlocked position. This is shown by the movement of the handle portion 46 of the shaft/handle 40 in both figures. It should also be noted that angular displacements other than 135 degrees are also possible, as long as the rotational movement is sufficient to move the locking cam far enough away from the keeper to permit sliding movement of the sash window, and although it may be desirable, the cam need not even be fully retracted within the housing 10.

The above noted interaction between the sash lock assembly 100 and the latch assemblies 200L/200R may be through the use of the following latch assembly configuration. A discussion of the left-hand latch assembly 200L is presented, with the understanding that the right-hand latch assembly 200R may be a mirrored version, except where otherwise noted.

Figure 58:
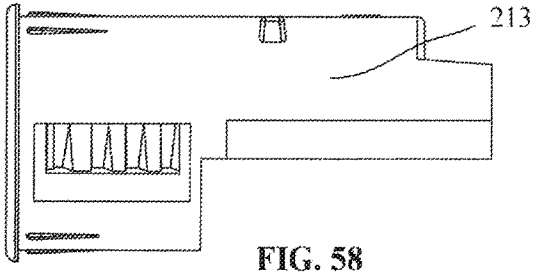
FIG. 58 is a bottom view of the latch housing of FIG. 53.
Figure 70:
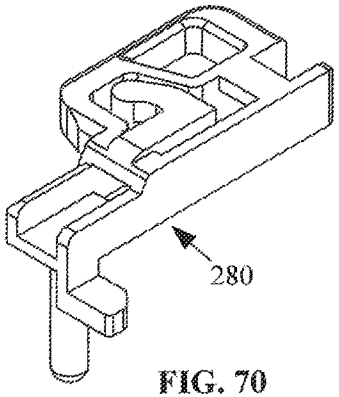
FIG. 70 is a fourth perspective view of the receiver clip FIG. 67.
Figure 69:
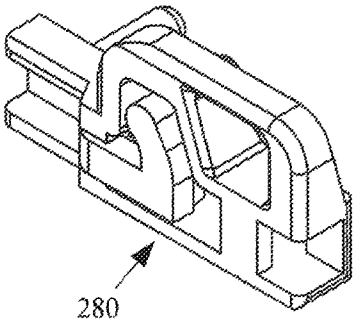
FIG. 69 is a third perspective view of the receiver clip FIG. 67.
Figure 68:
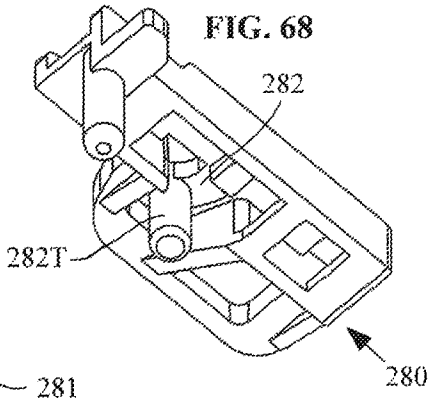
FIG. 68 is a second perspective view of the receiver clip FIG. 67.
Figure 67:
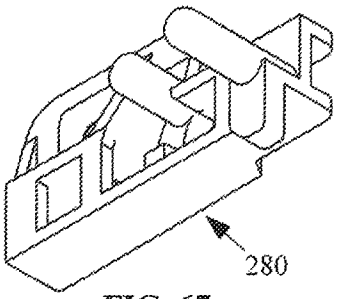
FIG. 67 is a first perspective view of a receiver clip used in the latch assembly of FIG. 1.
Figure 76:
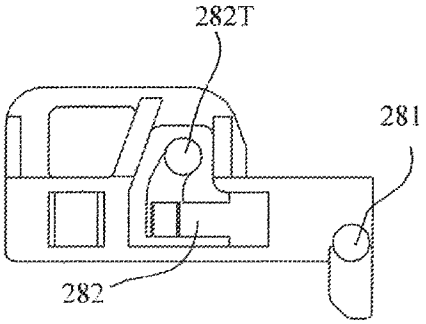
FIG. 76 is a bottom view of the receiver clip of FIG. 67.
Figure 74:
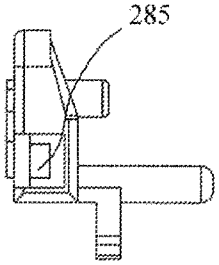
FIG. 74 is a first end view of the receiver clip of FIG. 67.
Figure 72:
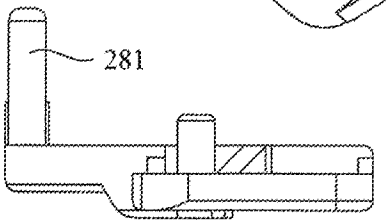
FIG. 72 is a first side view of the receiver clip of FIG. 67.
Figure 71:
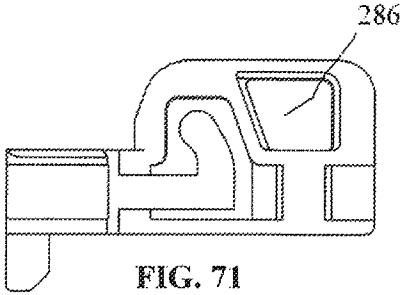
FIG. 71 is a top view of the receiver clip of FIG. 67.
Figure 73:
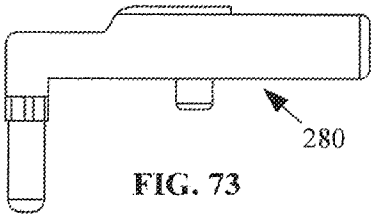
FIG. 73 is a second side view of the receiver clip of FIG. 67.
Figure 75:
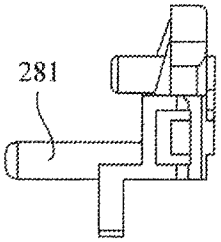
FIG. 75 is a second end view of the receiver clip of FIG. 67.

The latch assembly may include a latch housing member 210, shown in FIGS. 53 to 58, which may have a simple exterior surface (e.g., generally cylindrical), the complement of which may be easily formed (e.g., bored) into the sliding sash window frame, to permit ease of its installation therein. The housing 210 is not limited to the shape illustrated within those figures, and could take on many different appropriate shapes, including an elongated rectangular shape. However, at least a portion of the housing 210 may be desirably shaped to have a cylindrical outer surface 213, which may span from a first end 211 to second end 212 (FIG. 58). At the first end 211 of the housing 210, the cylindrical outer surface 213 may transition into a protruding lip 213C. A portion of the cylindrical outer surface 213 may also have a series of successive teeth (214A, 214B, 214C, 214D,) formed thereon, for releasable securing of the housing within the hole that is bored/formed in the window rail. The housing 210 may be hollowed out to form an interior surface 215. Protruding upward from the interior surface 215 may be one stop 216A or a pair of stops (216A and 216B). A wall 218 may protrude inward to obstruct a portion of the hollowed out interior between the first end 211 and the second end 212. The housing 210 being so formed may receive a latch member 250 therein.

Perspective views of the latch member 250 are shown in FIGS. 59-61, while corresponding orthogonal views are shown in FIGS. 62-66. The latch member 250 may extend from first end 251 to second end 252, and may include a tongue 253 that begins at the first end of the latch member and extends only part way to its second end. The tongue 253 may have a generally flat engagement surface 254E that may engage the track of the master window frame to prevent outward tilting of the sliding sash window, and it may also have an angled surface 254A that tapers toward the engagement surface 254E to create an apex. The angled surface 254A may be used, upon contact with the master window frame, to oppose biasing of the latch member and temporarily drive it into a retracted position, until the tongue enters the track of the master window frame, and is biased into its extended position to have the engagement surface 254E re-engage the track. The tongue 253 may also have one stop 266A protruding therefrom (FIG. 66) or a pair of stops (266A and 266B). Extending away from the tongue 253 may be an elongated beam 255 that may be flexible. The beam 255 may have a plurality of recesses therein (e.g., 255A, 255B, 255C, etc.), which may alternatively be formed as through-openings.

Figure 80:
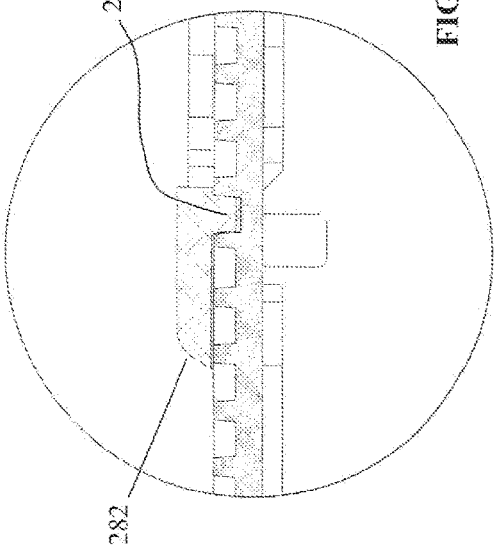
FIG. 80 is a cross-sectional view showing the receiver clip coupled to the latch member, as seen in FIG. 79.
Figure 81:
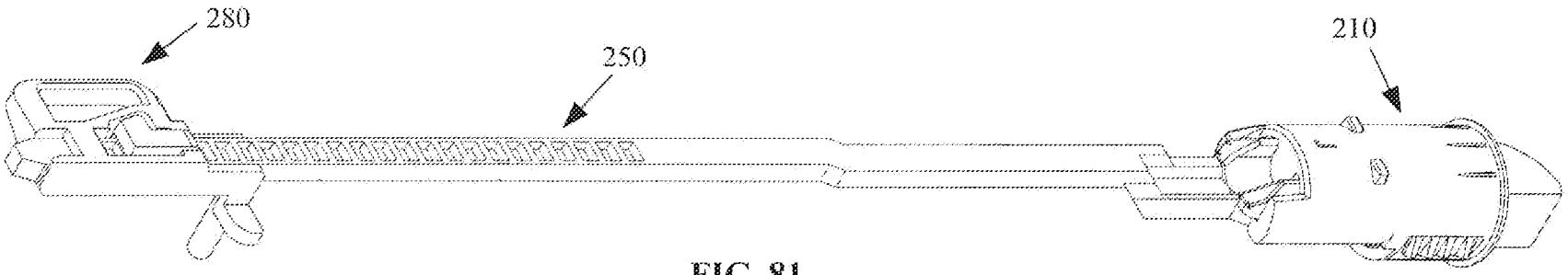
FIG. 81 is a reverse perspective view of the latch assembly shown in FIG. 79.

The beam 255 at the second end of the latch member 250 may be configured to receive a receiver clip 280 thereon. The receiver clip 280 is shown in FIGS. 67-76. The receiver clip 280 may have a body, which may be elongated, but in any case is configured to be small enough to be received through the same opening in the sash window frame that may also receive the cylindrical housing 210. The receiver clip 280 may have a post 281 protruding away from the body, which may be used to support the beam 255 of the latch member in the sash window frame, as discussed hereinafter. The receiver clip 280 may also have a through-opening 285, which may be configured to slidably receive the beam 255 of the latch member 250. The receiver clip 280 may be configured to engage the openings in the beam of the latch member (e.g., 255A, 255B, 255C, etc) similar to a ratchet arrangement, as the clip may have a flexible member 282 from which may protrude a protrusion 282P (see FIG. 80), protruding into an opening that may be oriented transversely to the opening 285. The receiver clip 280 may also have a transverse opening 286 that is configured to receive the end of the post of one of the lever arms therein. A post 282T may be formed on the flexible member to manually deflect the member.

Biasing of the latch member 250 relative to the housing 210 may be through the use of a suitably arranged tension spring, or by using a compression spring. For the sake of brevity, the figures herein only depict the embodiment where a compression spring is utilized.

Figure 77:
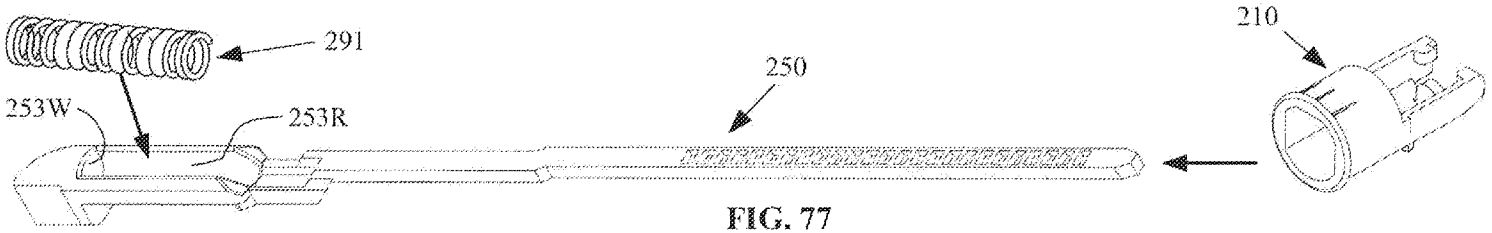
FIG. 77 is an exploded view showing the latch member of FIG. 59, the housing of FIG. 53, and a helical spring used for biasing the latch member with respect to the housing, in the latch assembly of FIG. 1.
Figure 78:
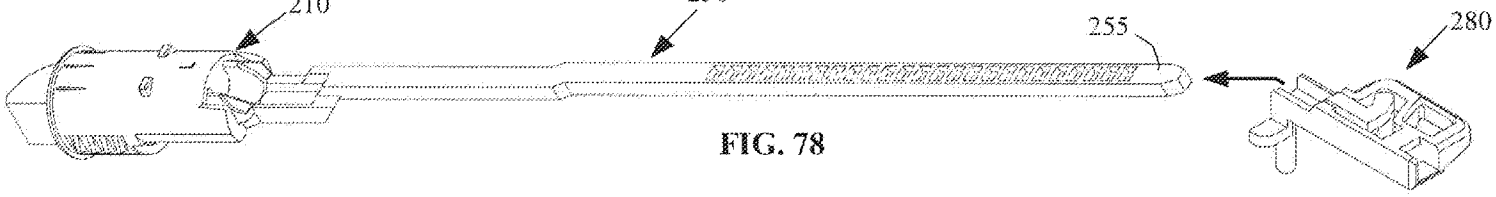
FIG. 78 is a perspective view showing the latch member, the helical spring, and the housing of FIG. 77, after being assembled together, and showing the receiver clip of FIG. 67, prior to being coupled with the latch member.
Figure 82:
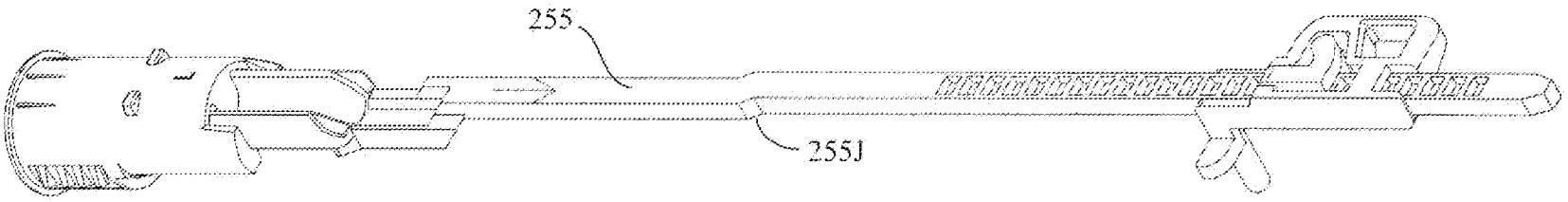
FIG. 82 is the perspective view of FIG. 79, but shown with the latch member in the retracted position within the housing, and shown with the receiver clip having been adjusted to occupy a different position upon the latch member.
Figure 85:
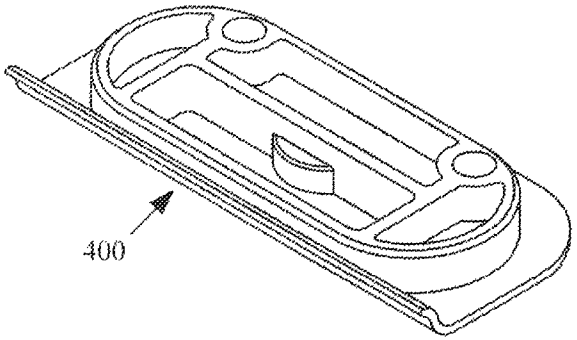
FIG. 85 is a third perspective view of the keeper shown in FIG. 83.
Figure 84:
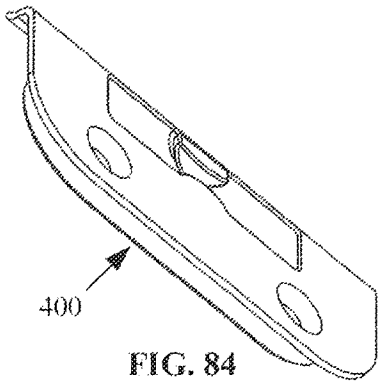
FIG. 84 is a second perspective view of the keeper shown in FIG. 83.
Figure 83:
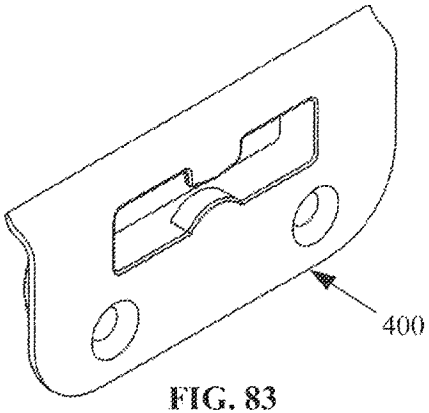
FIG. 83 is a perspective view of a keeper that may be mounted on a master window frame in which the sash window slides, to be useable for securing the cam of the lock assembly of FIG. 1 to the master window frame.
Figure 88:
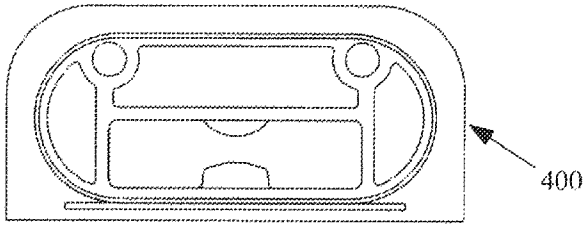
FIG. 88 is a top view of the keeper shown in FIG. 83.
Figure 86:
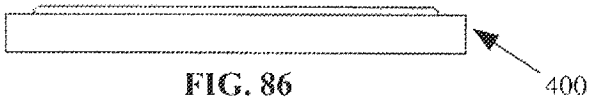
FIG. 86 is a front view of the keeper shown in FIG. 83.
Figure 87:
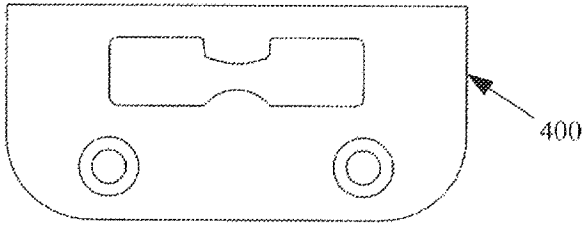
FIG. 87 is a bottom view of the keeper shown in FIG. 83.
Figure 89:
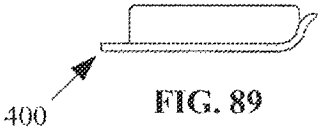
FIG. 89 is an end view of the keeper shown in FIG. 83.

The interior surface 215 of housing 210 may be contoured to receive the latch member 250 therein, in a slidable relation. Assembly of the helical compression spring 291 and the latch member 250 into the housing 210 is illustrated initially in FIG. 77. The helical spring 291 may be nested in a recess 253R proximate to the tongue 253. One end of the spring may act upon the wall 253W of the tongue 253, while the other end of the compression spring may act upon the wall 218 of the housing 210 (FIG. 55), to bias a portion of the tongue, including its apex, to protrude out from the latch housing, as seen in FIG. 78. The extent that biasing by spring 291 may cause the tongue 253 to protrude out from the housing 210 may be limited by the stops 266A and 266B on the tongue contacting the stops 216A and 216B on the housing (FIG. 63). Actuation of the latch member 250 relative to the housing 210 may cause the apex of the tongue to retract within the hollow of the housing, as seen in FIG. 82.

Figure 79:
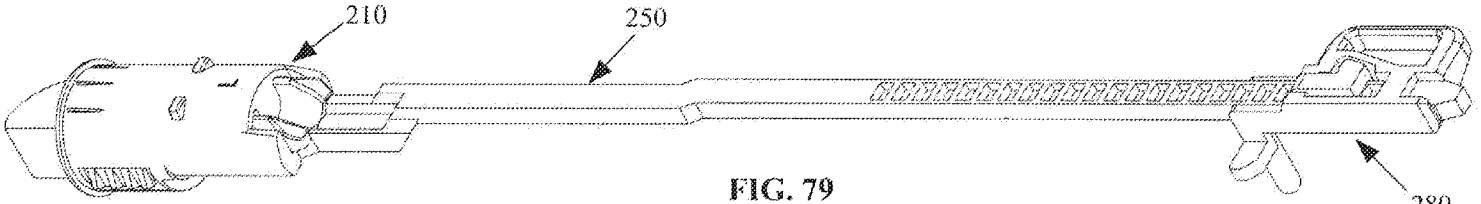
FIG. 79 is the perspective view of FIG. 78, but shown after the receiver dip is adjustably coupled to the latch member.

FIG. 78 illustrates the through-opening 285 of the receiver clip 280 just prior to being aligned with the end of the beam 255 of the latch member 250, and with it being slid thereon in FIG. 79. Engagement of the protrusion 282P of the flexible member 282 with one of the plurality of recesses/openings in the beam 255 is shown in the cross-sectional view of FIG. 80. This ratchet-like engagement of the receiver clip 280 with the beam 255 permits the latch assembly to be used upon sash windows of various different widths (i.e., where a narrower width window frame is utilized, the receiver clip may be moved closer towards the tongue of latch member with engage with a suitable recess/opening when appropriately positioned). It should also be noted that the beam 255 of the latch member 210 may have a joggle 255J therein, which, being large enough (larger than illustrated in FIG. 82), may serve to keep the latch members of the left-hand and right-hand latch assembles from obstructing each other upon installation into a sash window frame with a very small width. The joggle may also be positioned closer to the tongue end of the latch member. The opening 286 in the receiver clip 280 may also be appropriately positioned, where the larger joggle is utilized, to receive the post of the lever arms, once the sash lock assembly is installed upon the meeting rail of the window frame, as discussed hereinafter. This embodiment may require that the latch member for the left-hand and right-hand latch assemblies not be a mirror image copy.

To accommodate installation of the latch assemblies 200L and 200R, the sash window frame 300, as illustrated in FIGS. 92-95, may have a first opening 310 on one side of the frame, and a second opening 311 on a second side of the frame. The sliding sash window 300 may have a horizontal meeting rail 301, a first vertical stile 302A extending downward therefrom, and a second stile 302B and a bottom rail (not shown), which may form a framed enclosure to support the glazing therein.

Figure 96:
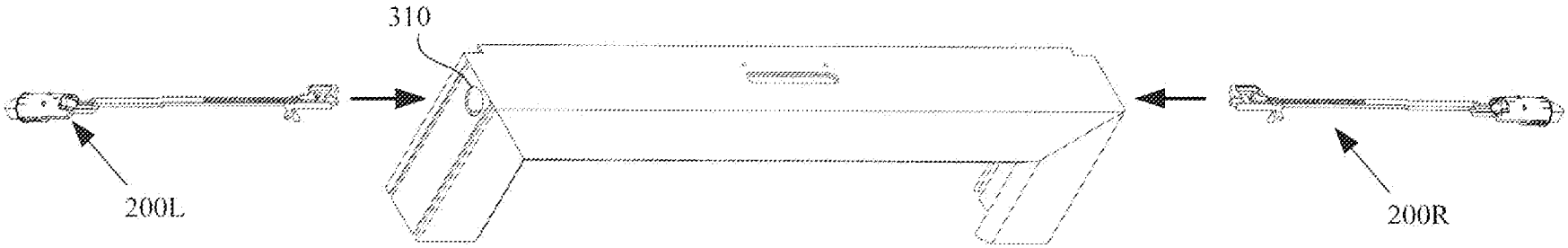
FIG. 96 is an exploded view showing the sash window frame of FIG. 92, and a left-hand and a right-hand latch assembly prior to being received into the openings therein.
Figure 97:
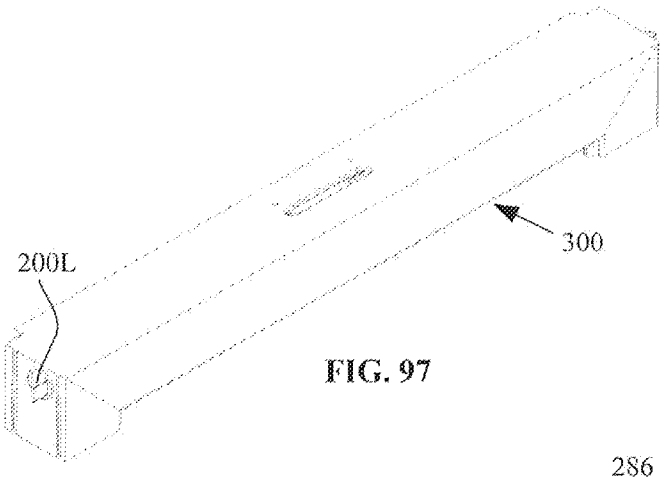
FIG. 97 illustrates a perspective view of the sash window frame of FIG. 96, but is shown after the right-hand and left-hand latch assemblies have been received in the corresponding opening in each side of the window frame.
Figure 98:
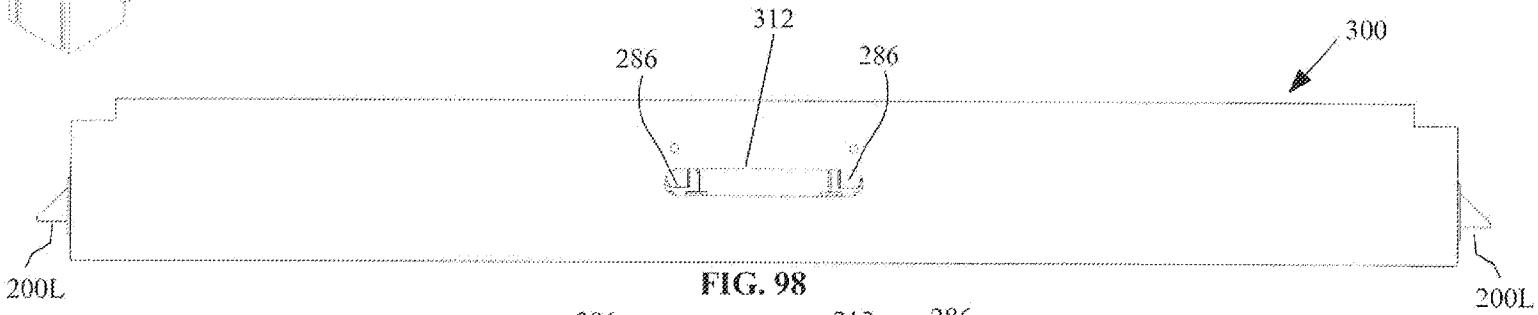
FIG. 98 is a top view of the sash window frame with latch assemblies installed therein, as shown in FIG. 97.
Figure 99:
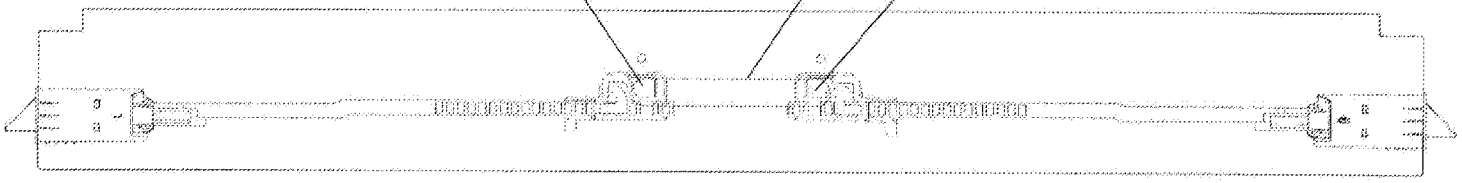
FIG. 99 is the top view of FIG. 98, but is illustrated as a transparent view to show the portions of each latch within the hollow interior of the window frame.

Installation of the latch assemblies 200L and 200R is shown initially in FIG. 96. The end of each latch assembly having the receiver clip 280 thereon may be received through the respective opening in the window frame, to be as seen in FIGS. 97-100. The latch assembly may be size adjusted, based upon proper positioning (horizontal alignment) of the opening 286 in the receiver clip 280 with the appropriate side of the top opening 312 in the meeting rail of the window frame (see FIG. 99). It should be noted that the recesses/openings (e.g., 255A, 255B, 255C, etc.) in the beam 255 of the latch member 250 may have markings thereon, so that the receiver clip 280 may be pre-positioned at the proper opening for use with a particular width of window, prior to its installation in the window frame, thereby eliminating the need for adjustment at that time.

Figure 100:
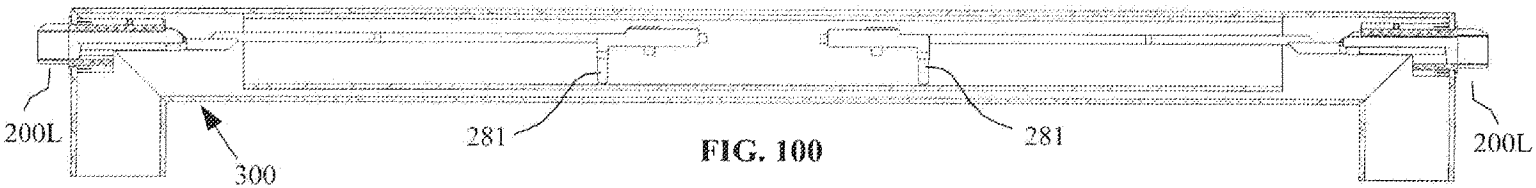
FIG. 100 is a front view of the sash window frame with latch assemblies installed therein, as shown in FIG. 99.

As seen for the installed latch assemblies 200L and 200R in FIG. 100, the post 281 on each receiver clip 280 may contact the bottom of the meeting rail to support for the beam 255 at the appropriate height within the hollow frame.

Figure 92:
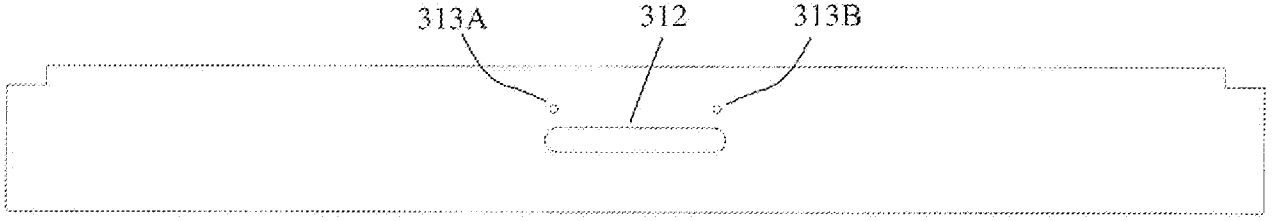
FIG. 92 is a top view of a sliding sash window frame having a cutout on the top of the meeting rail to receive the lever arms of the sash lock assembly, and a pair of holes to receive a pairs of screws for mounting of the sash lock assembly thereto.
Figure 93:
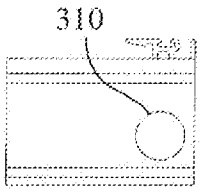
FIG. 93 is a first side view of the sash window frame of FIG. 92, showing an opening in the window frame to receive a first latch assembly therein.
Figure 95:
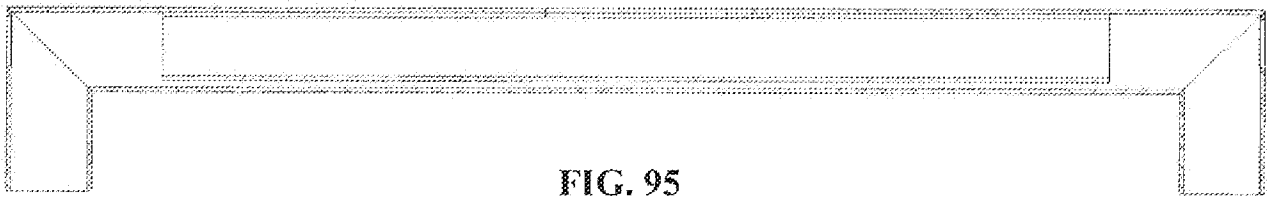
FIG. 95 is a front view of the sash window frame of FIG. 92.
Figure 101:
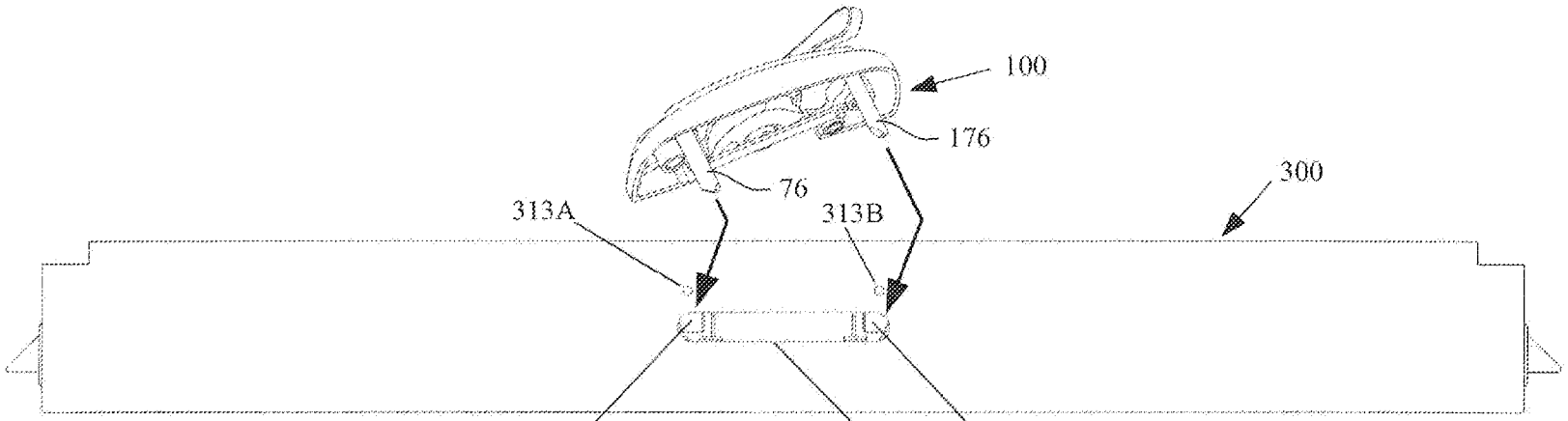
FIG. 101 is the top view of the sash window frame with latch assemblies installed therein, as shown in FIG. 98, but is also shown with the lock assembly of FIG. 51, just prior to being installed upon the meeting rail.

The initial installation of the sash lock assembly 100 upon the sash window frame 300 is illustrated in FIG. 101. As seen in FIG. 92 and FIG. 101, the top of the meeting rail 301 may have an elongated opening 312 formed therein, adjacent to which may be a first hole 313A, and a second opening 313B. The elongated opening 312 may be shaped and positioned to suitably provide clearance for the footprint of posts 76 and 176 of the first and second lever arms 70 and 170, when in the diverged position of FIG. 50, when in the converged position of FIG. 120, and for its movement therebetween.

Figure 102:
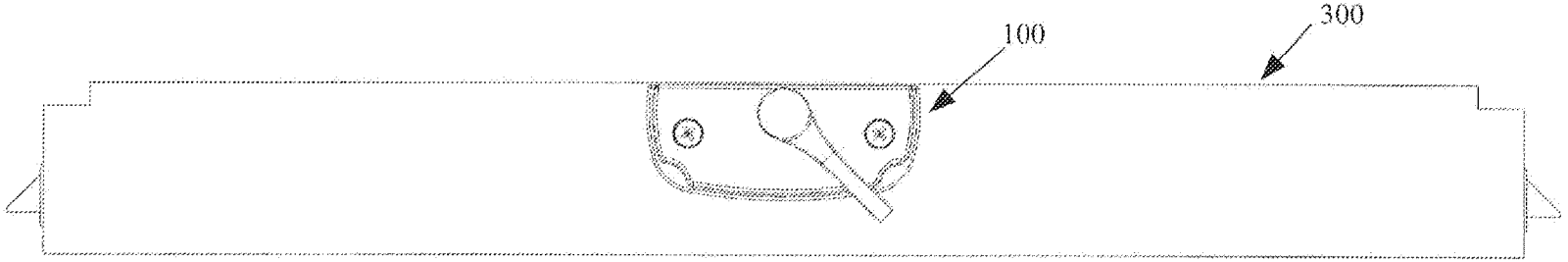
FIG. 102 is the top view of FIG. 101, but shown after the lock assembly has been installed upon the meeting rail of the window frame, mated with the latch assemblies therein, and secured to the frame using screws.
Figure 103:
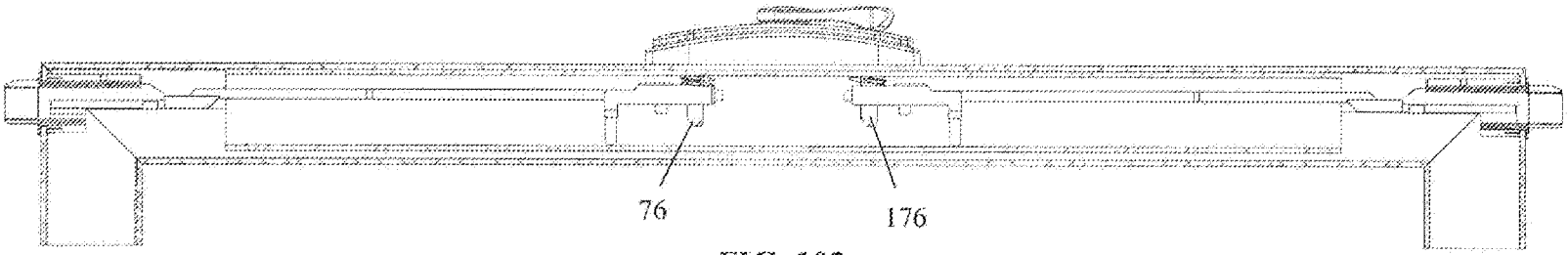
FIG. 103 is as front cross-sectional view of the sash window frame of FIG. 102, shown with the latch assemblies and the lock assembly installed thereon and mated together.
Figure 104:
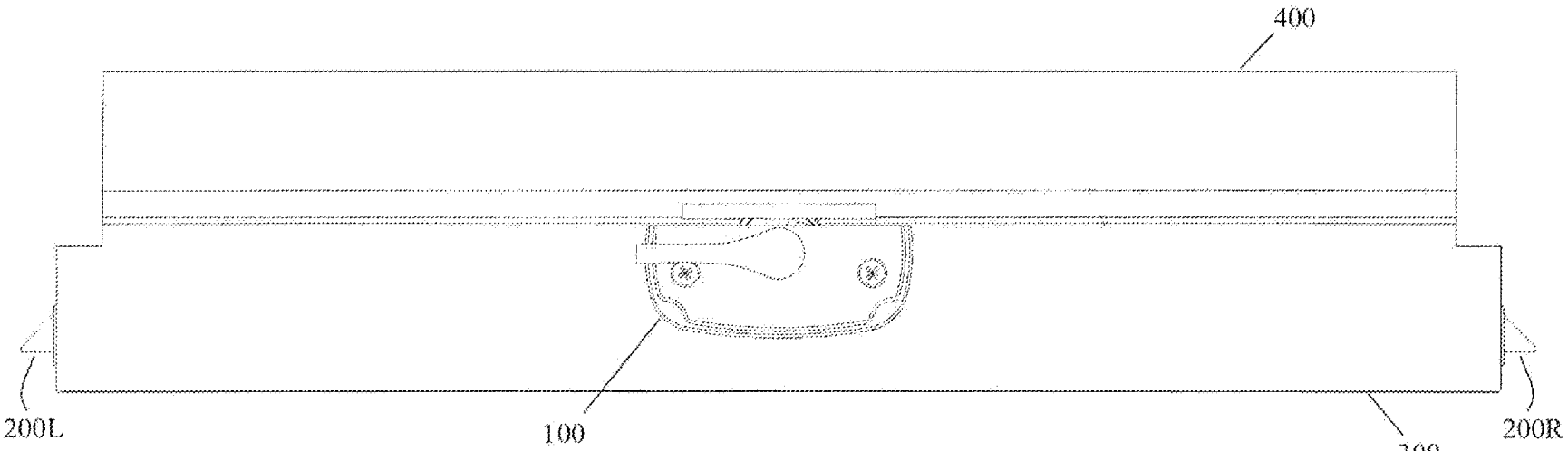
FIG. 104 is a top view of the window frame with the latch assemblies and the lock assembly installed thereon and mated together, as seen in FIG. 102, but is shown with the window frame in a closed position in the master window frame, and with the integrated sash lock/tilt latch fastener in the locked and latched position, with respect to the keeper on the master frame and a track therein.
Figure 105:
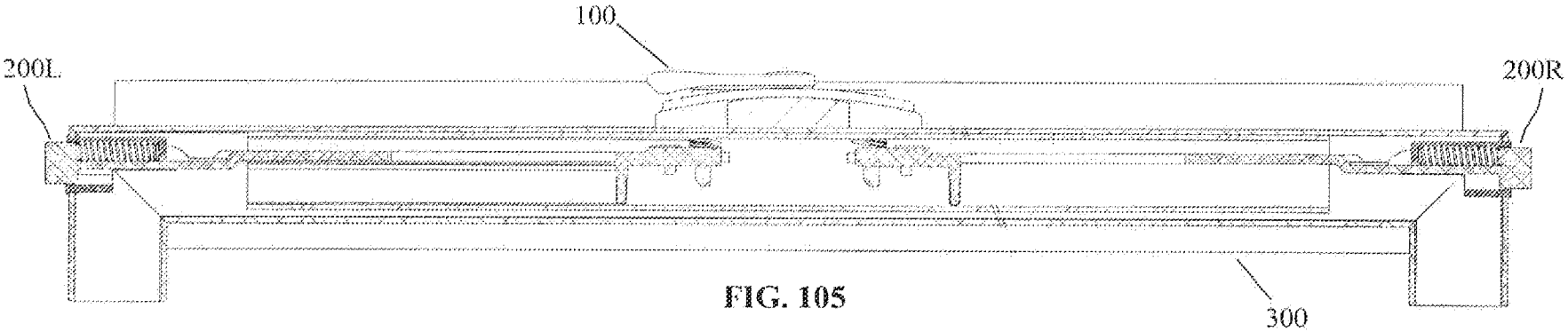
FIG. 105 is a front cross-sectional view of the window frame with the latch assemblies and the lock assembly installed, thereon and mated together, as seen in FIG. 104, being shown with the integrated sash lock/tilt latch fastener in the locked and latched position.
Figure 109:
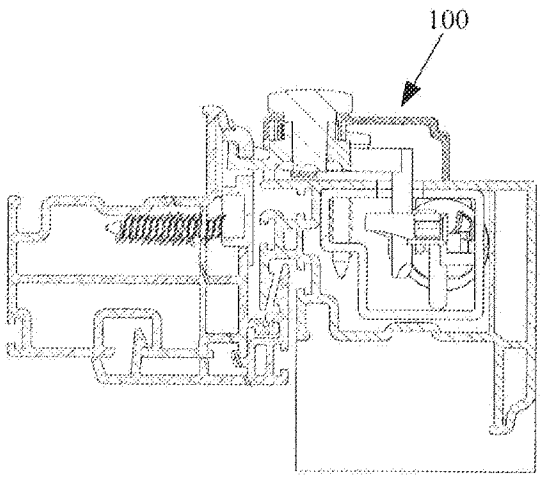
FIG. 109 is a cross-sectional view through the integrated sash lock/tilt latch fastener as installed and positioned in FIG. 106.
Figure 108:
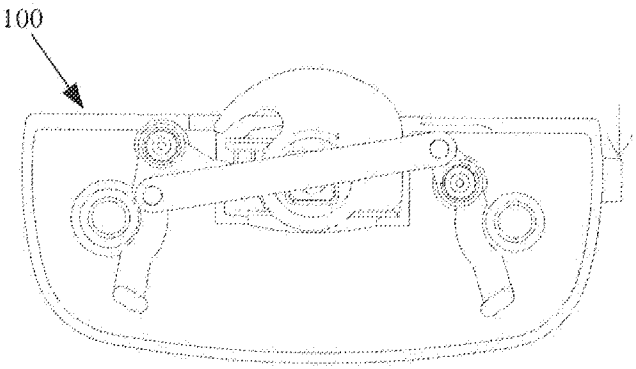
FIG. 108 is a bottom view of the lock assembly of FIG. 107.
Figure 106:
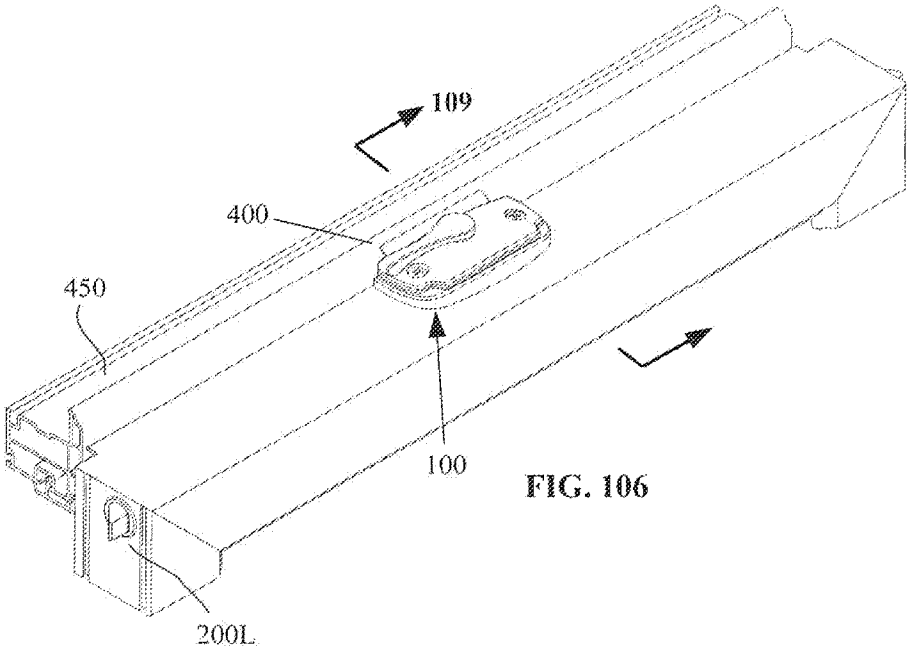
FIG. 106 a perspective view of the window frame with the latch assemblies and the lock assembly installed thereon and mated together, as seen in FIG. 104, being shown with the integrated sash lock/tilt latch fastener in the locked and latched position.
Figure 107:
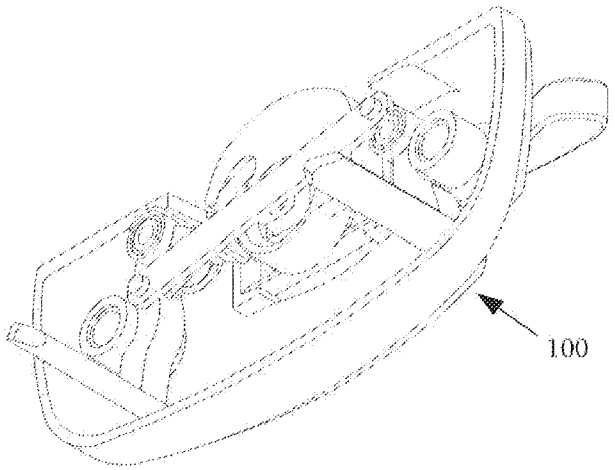
FIG. 107 is a perspective view of the lock assembly as seen in FIG. 106, showing the positioning of its components, with the integrated sash lock/tilt latch fastener in the locked and latched position.
Figure 110:
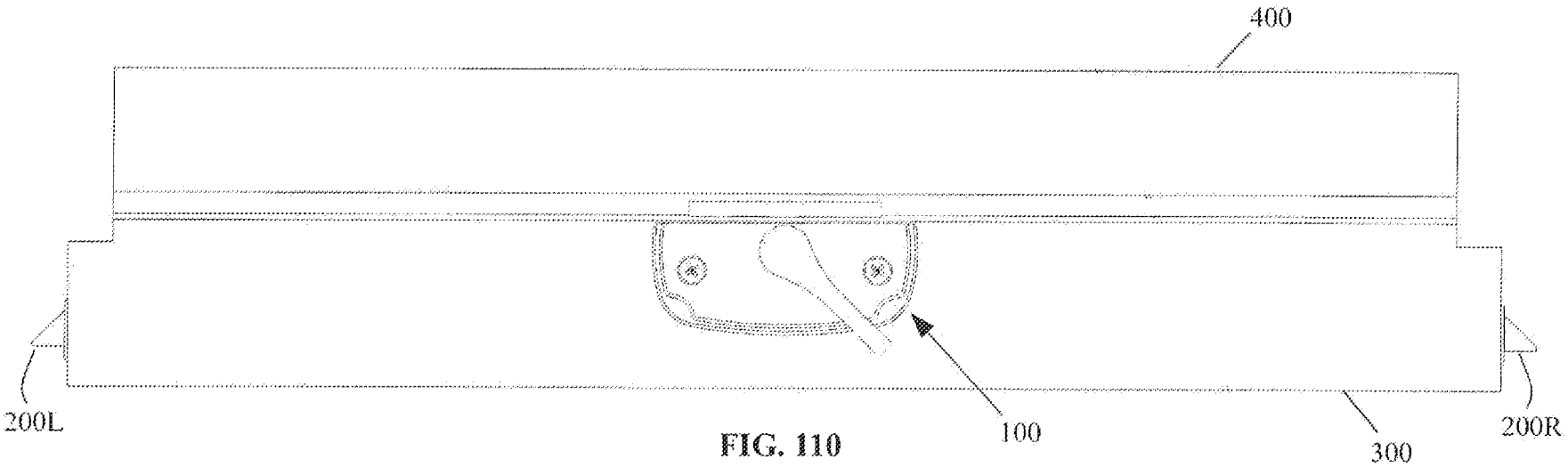
FIG. 110 is the top view of the window frame with the latch assemblies and the lock assembly installed thereon and mated together, as seen in FIG. 104, but shown with the integrated sash lock/tilt latch fastener in the unlocked and latched position with respect to the keeper on the master frame, so that it may slide therein.
Figure 111:
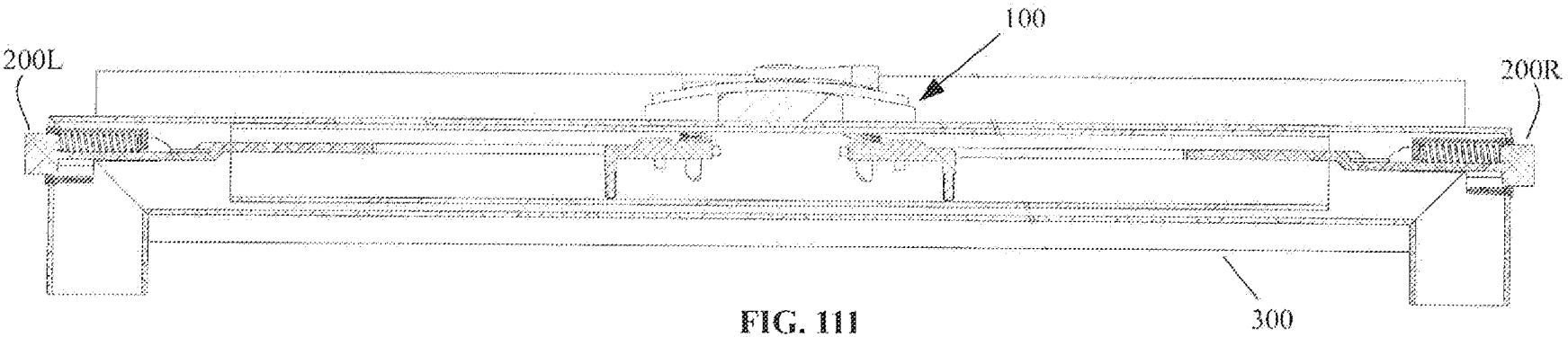
FIG. 111 is a front cross-sectional view of the window frame with the latch assemblies and the lock assembly installed thereon and mated together, as seen in FIG. 110.
Figure 112:
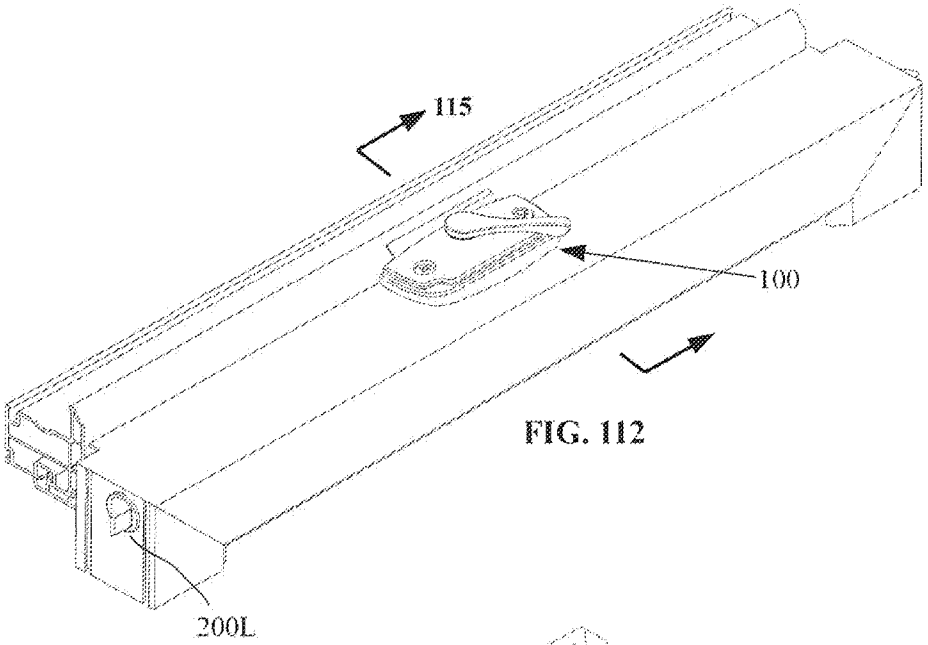
FIG. 112 a perspective view of the window frame with the latch assemblies and the lock assembly installed thereon and mated together, as seen in FIG. 110.
Figure 115:
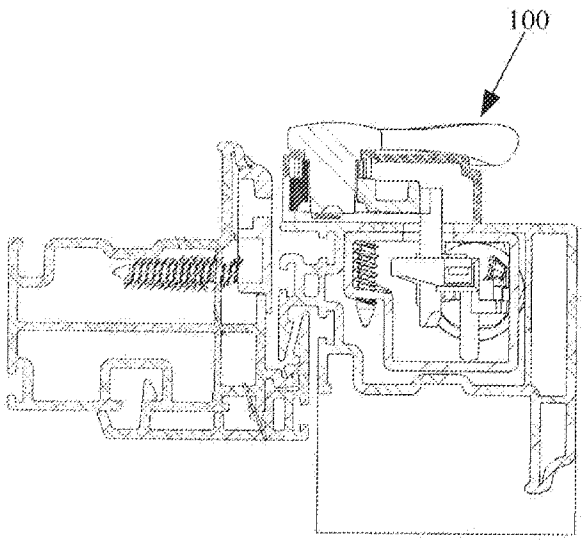
FIG. 115 is a cross-sectional view through the integrated sash lock/tilt latch fastener as installed and positioned in FIG. 112.
Figure 113:
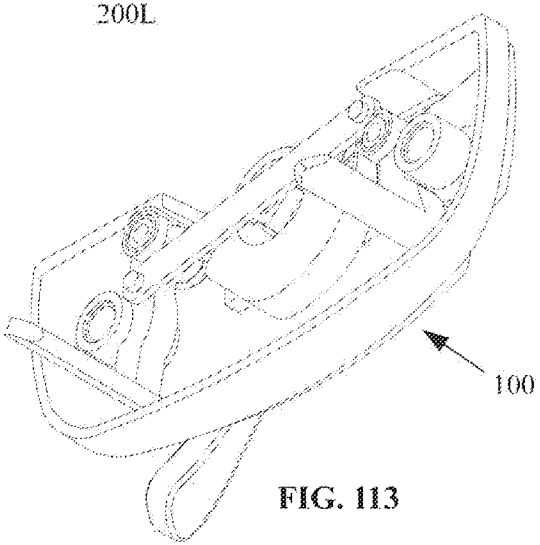
FIG. 113 is a perspective view of the lock assembly as shown in FIG. 112, showing the positioning of its components, with the integrated sash lock/tilt latch fastener in the unlocked and latched position.
Figure 114:
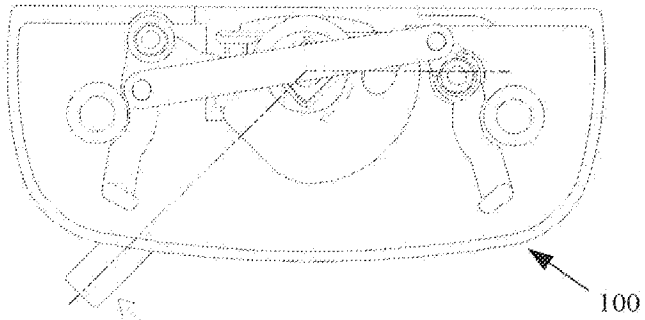
FIG. 114 is a bottom view of the lock assembly of FIG. 112.

The sash lock assembly 100 may be installed upon the rail 301 of the sliding sash window frame 300, so that the posts 76 and 176 of the first and second lever arms 70 and 170 are respectively received through the corresponding openings 286 of the receiver clips of the left-hand and right-hand latch assemblies, as shown in FIG. 102 and FIG. 103.

Figure 90:
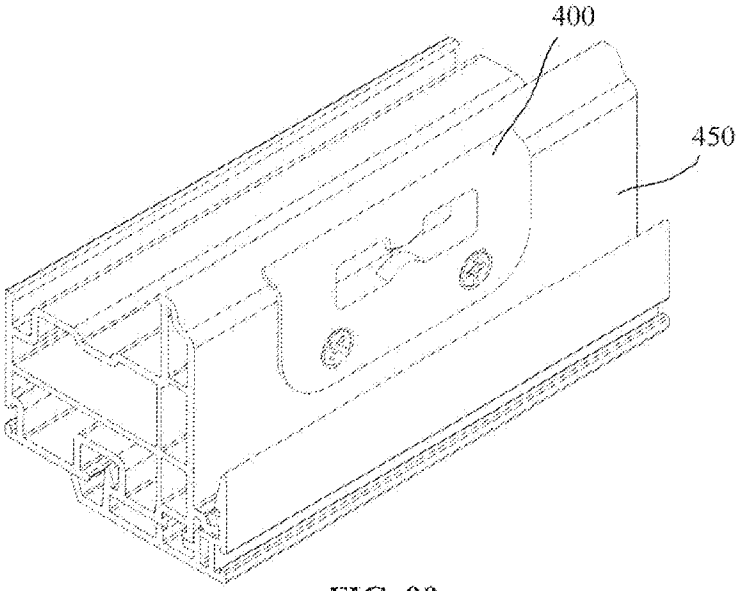
FIG. 90 is a perspective view showing the keeper of FIG. 83 mounted to a portion of the master window frame.
Figure 91:
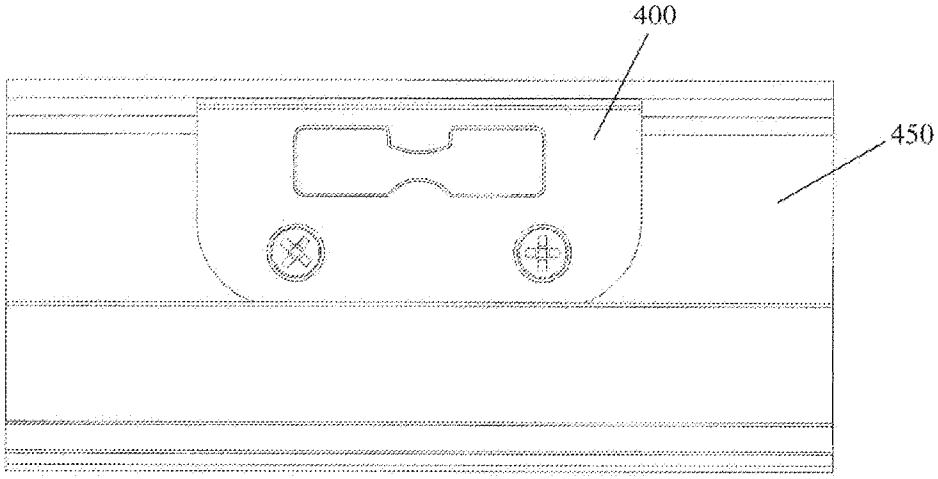
FIG. 91 is a top view showing the keeper mounted to the master frame, as seen in FIG. 90.
Figure 94:
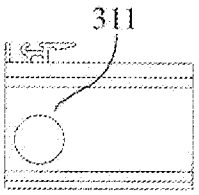
FIG. 94 is a second side view of the sash window frame of FIG. 92, showing a second opening in the window frame to receive a second latch assembly therein.

The sash lock assembly 100 and the left-hand and right-hand latch assemblies 200L/200R are shown installed in the sliding sash window 300, in FIGS. 104-109, with the sash window slidably installed with respect to the master window frame 450, and with the sash lock in the locked and latched position (being inhibited from sliding and tilting). Although not visible within FIG. 106, with the shaft/handle 40 in the lock position therein, the cam 50 is engaged with the key of the keeper 400 that is installed upon the master window frame 450 (or that may instead be installed upon a second sash window for a double hung arrangement). Note that a suitable keeper 400 is defined in FIGS. 83-88, the installation of which upon the master window frame 450 is shown in FIGS. 90-91.

A series of additional views showing the integrated sash lock/tilt latch fastener installed upon the sliding sash window 300, and in the unlocked and latched position the window being slidable but inhibited from tilting), are shown within FIGS. 110-115.

A series of other views showing the integrated sash lock/tilt latch fastener installed upon the sliding sash window 300, and being manually held in the unlocked and unlatched position to oppose the biasing provided, by the latch assemblies (the window thereby being free to be tilted out of the master frame), are shown within FIGS. 116-122. Upon release of the manual force to oppose the biasing, the integrated sash lock/tilt latch fastener moves back into the unlocked and latched position, as shown within FIGS. 123-129.

The examples and descriptions provided merely illustrate preferred embodiments of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A combination locking and tilt latching fastener, for use on a frame of a sash window configured to slide and tilt with respect to a master window frame, said fastener comprising:

a first latch assembly and a second latch assembly, each comprising: a housing having a first end and a second end, a latch member, a biasing means, and a receiver clip; said latch member comprising a plurality of in-line, equally-spaced openings; said latch member slidably received within said housing to be slidable between a retracted position and an extended position where a first end of said latch member protrudes out from said housing first end; said biasing means configured to bias said latch member toward said extended position; said receiver clip comprising a through opening configured to receive a portion of said latch member therethrough, and said receiver clip comprising a flexible member with a protrusion thereon configured to normally protrude transversely into said through opening, to be releasably received in one of said plurality of in-line openings of said latch member, for adjustable coupling of said receiver clip to said latch member, and said receiver clip comprising a transverse opening; each of said first latch assembly and said second latch assembly configured to be received through a respective opening in a first side and a second side of the sash window frame, with said housing of each latch assembly respectively secured thereto;

a lock assembly configured to be mounted to a meeting rail of the sash window frame, said lock assembly comprising: a housing; a cam pivotally mounted to said housing and configured to engage a portion of the master frame when pivoted into an extended position to lock the sliding sash window; a handle fixedly secured to said cam, and configured to drive said cam to rotate between said extended position, a first retracted position, and a second retracted position; a first arm and a second arm each pivotally mounted to said housing, and configured to extend through an opening in the meeting rail, to be engaged within said transverse opening of said receiver clip of said first latch assembly and second latch assembly, respectively, said cam configured for rotation thereof to cause corresponding counter-rotation of said first arm; and a link member pivotally coupled to each of said first arm and said second arm, to cause rotation of said second arm upon said counter-rotation of said first arm;

a detent configured to releasably secure said cam at each of said extended position, said first retracted position, and said second retracted position, said detent comprising: a leaf spring and said cam comprising a cylindrical hub with at least three flat portions formed thereon, wherein said leaf spring is configured to engage each of said three flat portions of said cam hub to releasably limit said pivotal movement of said cam at said extended position, said first retracted position, and said second retracted position, respectively;

wherein said cam in said first retracted position is configured to be disengaged from the master frame to permit sliding of the sash window; and wherein movement of said cam into said second retracted position is configured to actuate said first arm, and simultaneously actuate said second arm, to drive said respective latch members of said first latch assembly and said second latch assembly into said retracted latch member position, to permit tilting of the sash window with respect to the master frame.

2. The combination locking and tilt latching fastener according to claim 1, wherein said biasing of said latch member by said biasing means is further configured for normally biasing said cam from said second retracted position towards said first retracted position.

3. The combination locking and tilt latching fastener according to claim 1, wherein said receiver clip comprises a post of a selective length, configured to protrude down from a bottom of said receiver clip and contact a bottom of said meeting rail to support a distal end of said latch member.

4. The combination locking and tilt latching fastener according to claim 1, wherein each of said first arm and said second arm are L-shaped, having a first leg and a second leg, with said first leg configured for said pivotal mounting of said arm to said lock assembly housing, and said second leg configured for said engagement with said transverse opening of said receiver clip.

5. A combination lock and latch fastener for a slidable and tiltable sash window comprising:

a first latch assembly and a second latch assembly, each comprising:

a housing having a first end and a second end;

a latch member comprising a plurality of in-line, equally-spaced openings; said latch member received within said housing to be slidable between a retracted position and an extended position where a first end of said latch member protrudes out from said housing first end;

means for biasing said latch member toward said extended position; and a receiver clip comprising: a through opening configured to slidably receive said latch member; a flexible member with a protrusion thereon configured to normally protrude transversely into said through opening, to be releasably received in one of said plurality of in-line openings of said latch member, and a transverse opening;

a lock assembly comprising:

a housing;

a cam pivotally mounted to said housing;

a detent configured to releasably secure said cam at each of a lock position, a first unlock position, and a second unlock position;

a first arm and a second arm each pivotally mounted to said housing, and each configured for a portion thereof to be received within said transverse opening of said receiver clip of said first latch assembly and said second latch assembly, respectively;

a link member with first and second ends pivotally coupled at a selective location on each of said first arm and said second arm, respectively;

means for releasably limiting said pivotal movement of said cam at each of said lock position and said first unlock position;

wherein said cam is configured for rotation thereof to cause corresponding counter-rotation of said first arm, with said link configured for said counter-rotation of said first arm to cause rotation of said second arm;

wherein said cam in said first unlock position is configured to permit sliding of the sash window; and wherein movement of said cam from said first lock position into said second unlock position is configured to actuate said first arm and said second arm, to drive said respective latch members of said first latch assembly and said second latch assembly into said retracted latch member position, to permit tilting of the sash window.

6. The combination lock and latch fastener according to claim 5, wherein said biasing of said latch member by said means for biasing is further configured for normally biasing said cam from said second unlock position towards said first unlock position.

7. The combination locking and tilt latching fastener according to claim 5, wherein said receiver clip comprises a post of a selective length, configured to protrude down from a bottom of said receiver clip to support a distal end of said latch member.

8. The combination locking and tilt latching fastener according to claim 5, wherein each of said first arm and said second arm are L-shaped, having a first leg and a second leg, with said first leg configured for said pivotal mounting of said arm to said lock assembly housing, and said second leg configured for said engagement with said transverse opening of said receiver clip.

* * * * *